US005936654A

United States Patent [19]

Yokoyama et al.

[11] Patent Number: 5,936,654

[45] Date of Patent: Aug. 10, 1999

[54] INK SHEET REEL ON WHICH AN INK SHEET CAN BE WOUND, INK SHEET CARTRIDGE USING THE INK SHEET REEL, AND RECORDING APPARATUS USING THESE

[75] Inventors: Minoru Yokoyama; Takashi Awai, both of Yokohama; Yasushi Ishida, Tokyo; Akihiro Tomoda; Masakatsu Yamada, both of Yokohama, all of Japan

[73] Assignee: Canon Kabushiki Kaisha, Tokyo, Japan

[21] Appl. No.: 08/437,674

[22] Filed: May 9, 1995

Related U.S. Application Data

[63] Continuation of application No. 08/071,353, Jun. 3, 1993, abandoned, which is a continuation of application No. 07/560,999, Aug. 1, 1990, abandoned.

[30] Foreign Application Priority Data

Aug. 1, 1989 [JP] Japan ..... 1-198031
Jul. 26, 1990 [JP] Japan ..... 2-196194

[51] Int. Cl.[6] ..... B41J 32/00; B41J 17/16; B41J 17/18; B41J 17/32

[52] U.S. Cl. ..... 347/217; 347/214

[58] Field of Search ..... 347/214, 215, 347/217; 400/217, 221.1, 221.2, 225, 236, 236.2, 242, 246, 208

[56] References Cited

U.S. PATENT DOCUMENTS

| | | | |
|---|---|---|---|
| 4,425,036 | 1/1984 | Kameyama et al. | 355/3 DR |
| 4,702,631 | 10/1987 | Watanabe | 346/76 PH |
| 4,710,041 | 12/1987 | Shimada et al. | 346/76 PH |
| 4,768,039 | 8/1988 | Akutagawa et al. | 400/236 |
| 4,829,335 | 5/1989 | Kanemitsu et al. | 355/211 |
| 4,901,090 | 2/1990 | Ozawa et al. | 347/214 |
| 4,910,602 | 3/1990 | Sakugari | 347/215 |
| 4,924,242 | 5/1990 | Fukawa | 400/234 |
| 4,978,240 | 12/1990 | Katsuno | 400/234 |
| 5,047,803 | 9/1991 | Kanoto | 355/211 |

FOREIGN PATENT DOCUMENTS

| | | | |
|---|---|---|---|
| 58-212642 | 12/1983 | Japan . | |
| 0204585 | 11/1984 | Japan | 400/242 |
| 59-204585 | 11/1984 | Japan . | |
| 60-32687 | 2/1985 | Japan . | |
| 61-18654 | 1/1986 | Japan . | |
| 63-197679 | 8/1988 | Japan . | |
| 63-254085 | 10/1988 | Japan . | |

OTHER PUBLICATIONS

Eur. Pat. Off. Search Report for Eur. Pat. App. No. 90114715.7

*Primary Examiner*—Huan Tran
*Attorney, Agent, or Firm*—Fitzpatrick, Cella, Harper & Scinto

[57] ABSTRACT

An ink sheet reel capable,of being loaded into a recording apparatus has an ink sheet winding portion on which an ink sheet can be wound, and power transmission means provided so as to create an axial thrust in the ink sheet winding portion.

13 Claims, 15 Drawing Sheets

INK SHEET REEL ON WHICH AN INK SHEET CAN BE WOUND, INK SHEET CARTRIDGE USING THE INK SHEET REEL, AND RECORDING APPARATUS USING THESE

This application is a continuation of application Ser. No. 08/071,353 filed Jun. 3, 1993, now abandoned, which in turn is a continuation of application Ser. No. 07/560,999 filed Aug. 1, 1990, now abandoned.

BACKGROUND OF THE INVENTION

1. Field of the Invention

This invention relates to an ink sheet reel on which an ink sheet used in a heat transfer recording system can be wound, an ink sheet cartridge using this ink sheet reel, and a recording apparatus using these.

The term "recording apparatus" covers, for example, a facsimile apparatus, a typewriter, a copying apparatus and a printer.

2. Related Background Art

Description will hereinafter be made with a facsimile apparatus taken as an example of the recording apparatus.

In recent years, there has been developed a facsimile apparatus of the so-called heat transfer recording type which uses an ink sheet.

The facsimile apparatus of the heat transfer recording type offers the advantages that plain paper or the like can be used as a recording sheet and that images can be recorded clearly.

In the facsimile apparatus of said heat transfer recording type, a supply reel for supplying an ink sheet and a take-up reel for taking up the ink sheet from the supply reel are loaded into a loading portion such as a recording cover, or the supply reel and the take-up reel as an ink sheet cartridge (hereinafter referred to as the ink cartridge) contained in a container are loaded into the loading portion such as the recording cover, and in order to enable this loading to be accomplished smoothly and easily, there is provided some gap axially of the reels between the supply reel or the take-up reel and the loading portion.

However, in the conventional facsimile apparatus of the heat transfer recording type, spur gears are used as power transmission gears for the take-up reel and supply reel sides and power transmission gears for the conveying drive system side. Therefore, if a gap is provided between the supply reel or the take-up reel and the loading portion as previously described, the take-up reel and the supply reel may have lush in the axial direction, and this in turn leads to the disadvantage that oblique movement or skew or wrinkling of the ink sheet and unsatisfactory take-up of the ink sheet are caused.

Also, to prevent the oblique movement or the like of the ink sheet caused by the jolting of these reels, axial pressure (side pressure) must be applied to the reels and for this purpose, spring means or the like becomes necessary, and this means the invention requires an increased number of parts.

SUMMARY OF THE INVENTION

It is an object of the present invention to provide an ink sheet reel capable of receiving a drive force more reliably, an ink sheet cartridge using such ink sheet reel, and a recording apparatus using these.

It is another object of the present invention to provide an ink sheet reel capable of conveying an ink sheet without wrinkling the ink sheet, an ink sheet cartridge using such an ink sheet reel, and a recording apparatus using these.

It is still another object of the present invention to provide an ink sheet reel capable of being easily loaded, an ink sheet cartridge using such an ink sheet reel, and a recording apparatus using these.

It is yet still another object of the present invention to provide an ink sheet reel capable of being loaded with good accuracy, an ink sheet cartridge using such an ink sheet reel, and a recording apparatus using these.

It is a further object of the present invention to provide an ink sheet reel on which an ink sheet can be wound and which is made free of play or jolting in the axial direction without the number of parts being increased, whereby oblique movement or the like of the ink sheet can be effectively prevented to thereby improve the quality of recording of an ink sheet cartridge using such an ink sheet reel, and a recording apparatus using these.

It is still a further object of the present invention to facilitate the loading of a supply reel and a take-up reel for an ink sheet or of an ink cartridge cotaining the supply reel and the take-up reel in a container into a recording cover and yet eliminate the axial jolting of the ink sheet reel without increasing the number of parts.

It is yet still a further object of the present invention to provide an ink sheet reel on which an ink sheet can be wound and which can thus effectively prevent oblique movement or the like of the ink sheet to thereby improve the quality of printing possible, an ink sheet cartridge using such an ink sheet reel, and a recording apparatus using these.

Typical means of the present invention for achieving these object is characterized by being constituted by an ink sheet winding portion on which an ink sheet can be wound, and power transmission means provided in said ink sheet winding portion and creating an axial thrust in said ink sheet winding portion.

BRIEF DESCRIPTION OF THE DRAWINGS

FIGS. 3 to 6A–6B illustrate an ink cartridge.

DESCRIPTION OF THE PREFERRED EMBODIMENTS

An ink sheet reel on which an ink sheet to which the means of the prevent invention is applied can be wound, an ink sheet cartridge using such an ink sheet reel, and a recording apparatus using these will hereinafter be described with respect to a preferred embodiment thereof with reference to the drawings. The embodiment described hereinafter is designed such that when a rotational force is transmitted to a gear which is part of the power transmission means, an axial thrust is produced in the ink sheet winding portion of an ink sheet reel and the ink sheet winding portion is pressed toward an axial end side by this thrust and in the loading portion of the recording apparatus side, this ink sheet winding portion is stopped. Also, at this time, it is desirable that the thrust of the ink sheet reel of the supply side and the thrust of the ink sheet reel of the take-up side act in the same direction.

Thereby, even if an axial gap is present between the ink sheet reels and the loading portion therefore, the ink sheet reels may not jolt and oblique movement or the like of the ink sheet will not occur.

Also, in the case of an ink cartridge in which ink sheet reels are contained within a frame member, these thrusts are resisted not by the frame member, but by the loading portion of the recording apparatus side and therefore, any stress based on the thrusts is not produced in the frame member and it is not necessary to reinforce the frame member itself to increase its rigidity.

Figure 1A:
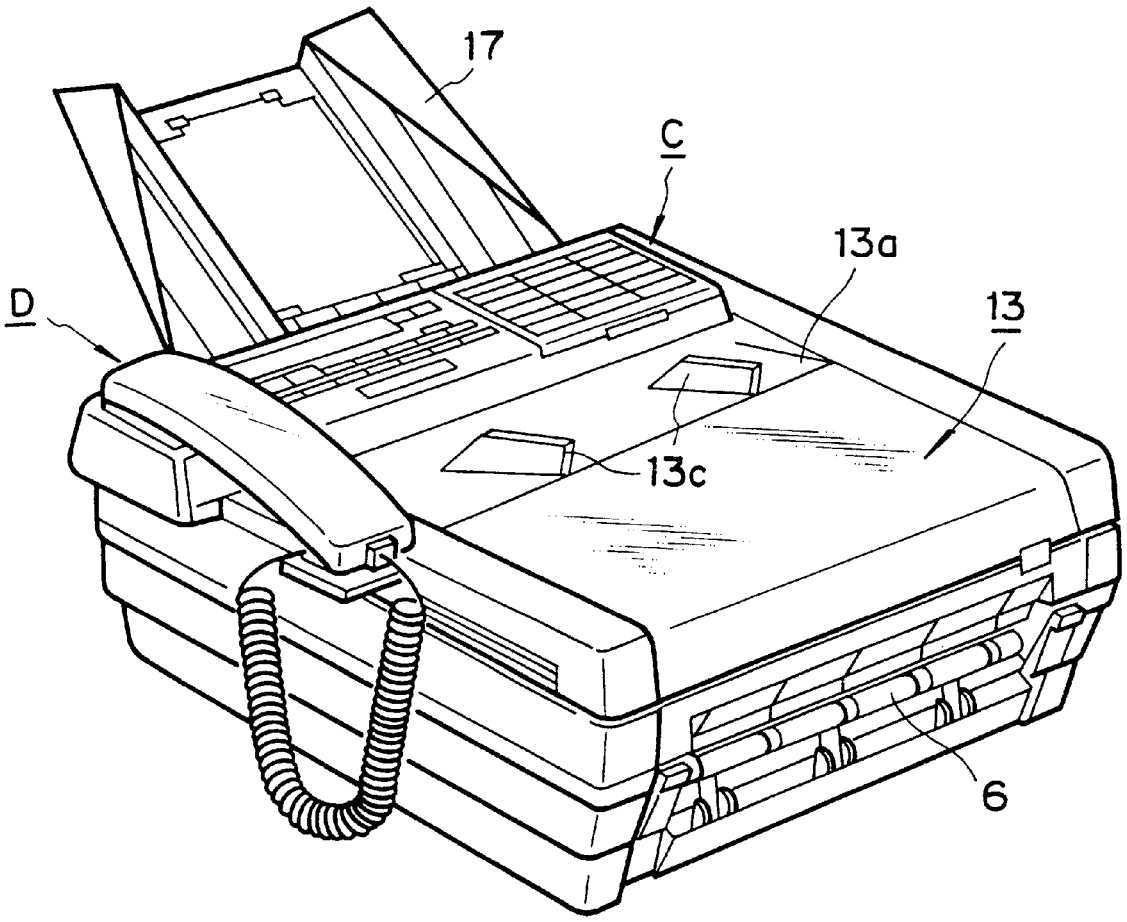
FIG. 1A is a pictorial perspective view of a facsimile apparatus.
Figure 1B:
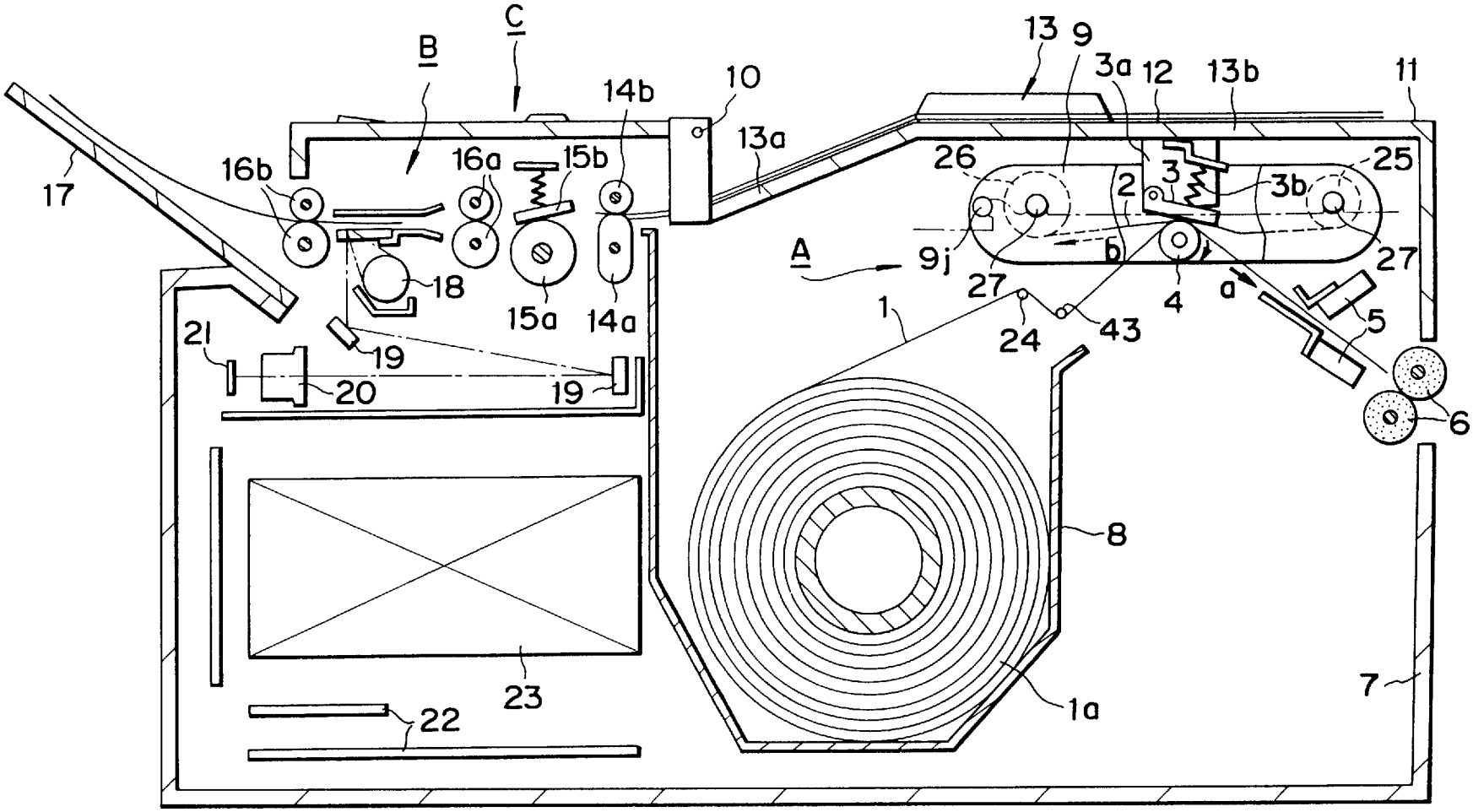
FIG. 1B is a cross-sectional view of the facsimile apparatus.
Figure 2A:
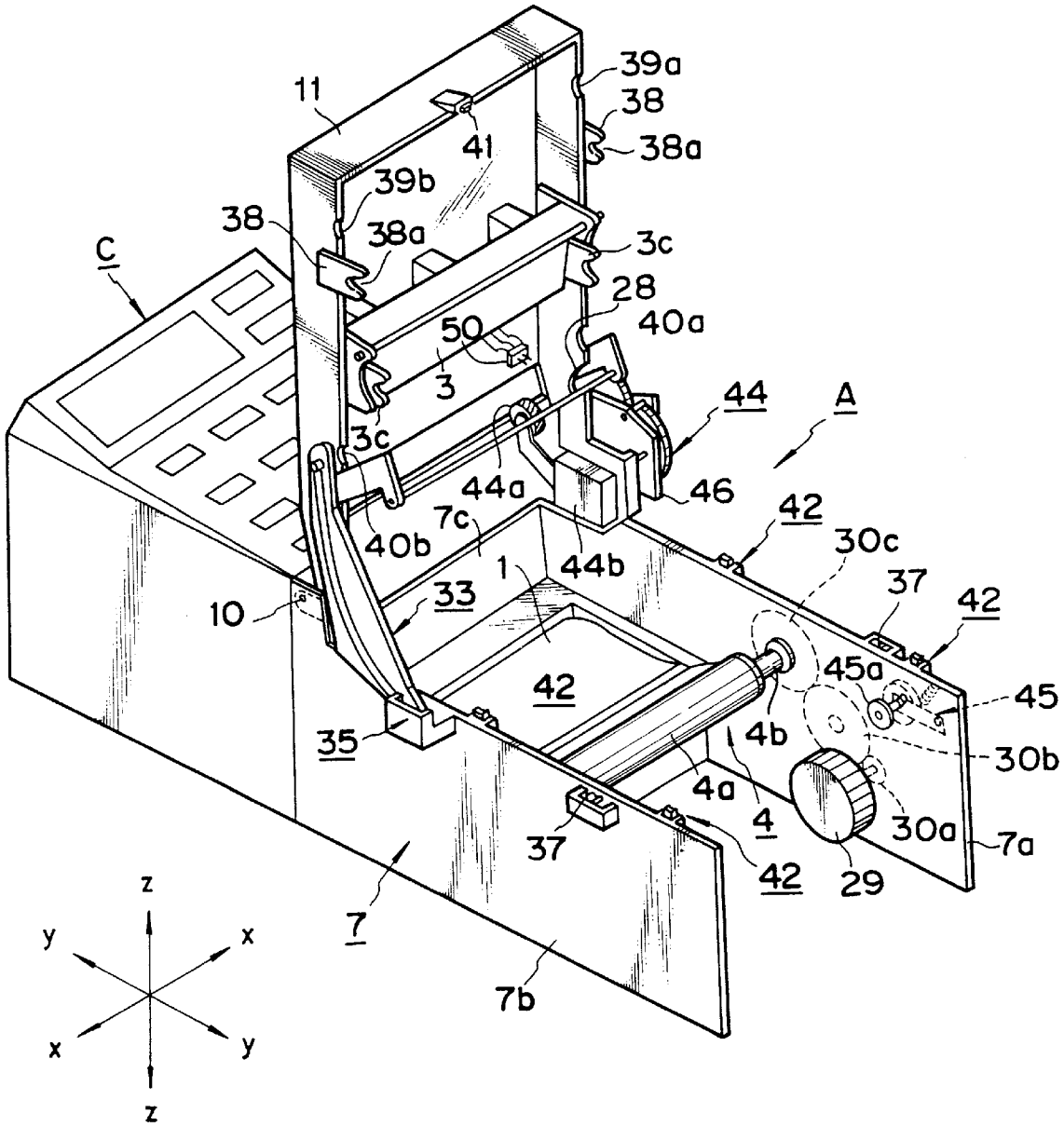
FIGS. 2A and 2B are perspective views of a recording apparatus.
Figure 2B:
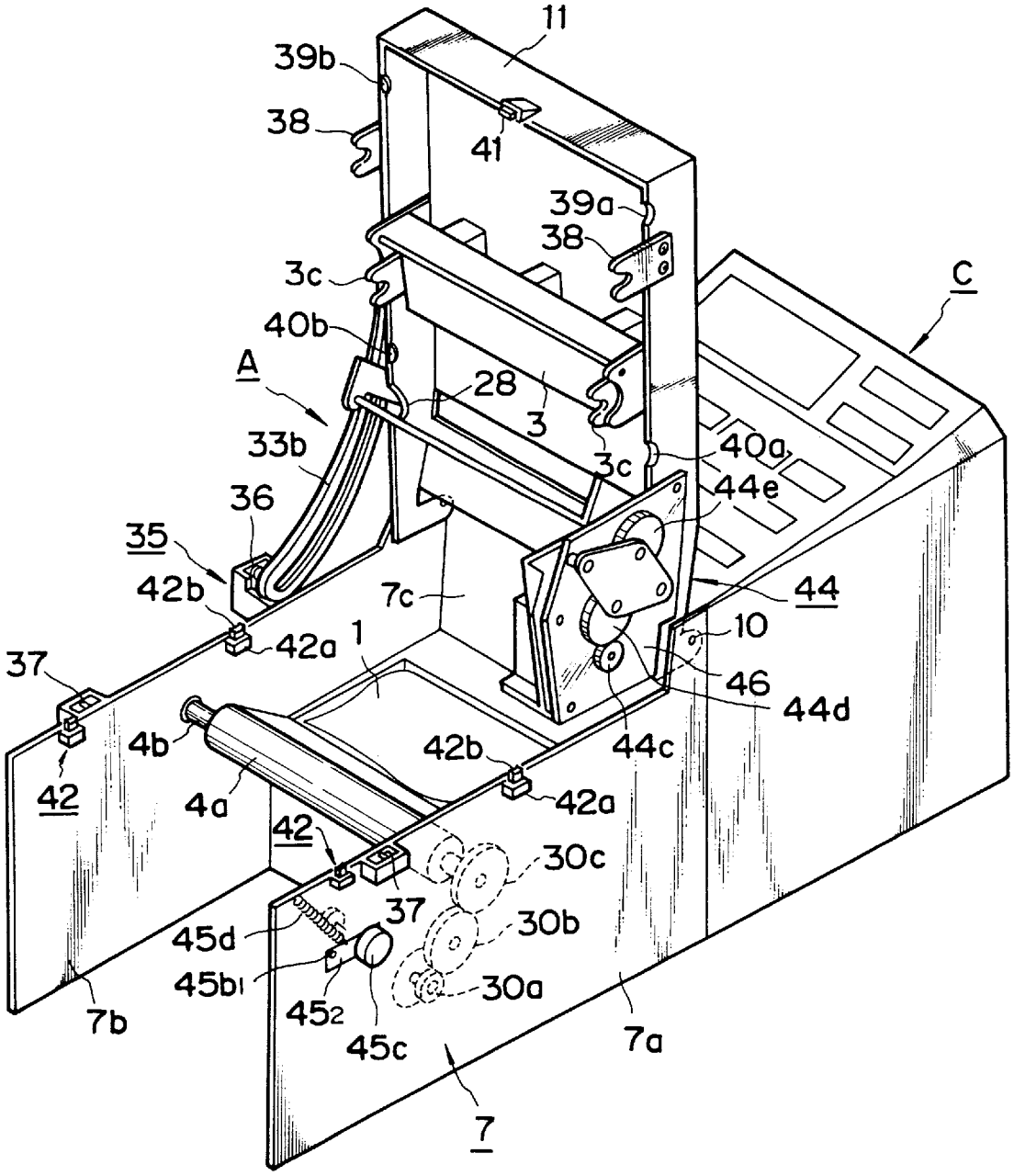

The recording apparatus A according to the present embodiment is constructed as the recording system of a facsimile apparatus. FIG. 1A is a pictorial perspective view of the facsimile apparatus, FIG. 1B is a cross-sectional view of the facsimile apparatus, and FIGS. 2A and 2B are perspective views of the recording apparatus A.

The general construction of the facsimile apparatus will first be briefly described with reference to FIGS. 1A and 1B and FIGS. 2A and 2B. Hereinafter, description will be made with defining the direction of arrow x in FIG. 2A as the lateral direction, the direction of arrow y as the longitudinal direction, and the direction of arrow z as the vertical direction.

The facsimile apparatus is comprised of the recording apparatus A as the recording system, a reading system B for reading the image of an original, and an operation panel C.

The recording apparatus A forms an image on a recording sheet 1 in conformity with an image signal transmitted from another apparatus or an image signal transmitted from the reading system B which will be described later.

That is, the recording sheet 1 and an ink sheet 2 overlapping each other are urged against a platen roller 4 by a recording head 3 as recording means, and when the platen roller 4 being driven in the direction of arrow, the recording sheet 1 is conveyed in the direction of arrow a, and by a driving mechanism 44 which will be described later, the ink sheet 2 is conveyed in the direction of arrow b. In the conveyance process of the recording sheet 1 and the ink sheet 2, the recording head 3 is driven in conformity with an image signal, whereby ink applied to the ink sheet 2 is melted (including sublimation) and the melted ink is transferred to the recording sheet 1 to thereby form an image. The recording sheet 1 on which a predetermined image has been formed is further conveyed in the direction of arrow a and is cut by a cutter 5, whereafter it is conveyed and discharged out of the recording apparatus A by a pair of conveying rollers 6.

The recording sheet 1 is contained in a roll holder 8 provided in the apparatus body 7. The roll holder 8, the platen roller 4, the cutter 5 and the pair of conveying rollers 6 are provided in the apparatus body 7.

In the present embodiment, the ink sheet 2 is inserted in an ink cartridge 9 which will be described later. The ink cartridge 9 is removably loaded in a recording cover 11 as a loading portion pivotably constructed in the apparatus body 7 through a pivot shaft 10. The recording head 3 is provided at a predetermined location in the recording cover 11.

The reading system B applies light to an original 12 and converts the light reflected therefrom into an electrical signal, and transmits this signal to another apparatus or the recording apparatus in conformity with the operation mode.

That is, a plurality of originals 12 are placed on an original supporting table 13 formed on top of the recording cover 11, and these originals 12 are preliminarily conveyed by a preliminary conveying roller 14*a* and a pressing roller 14*b* and are separated and individually fed by a separating roller 15*a* and a pressing piece 15*b* urged thereagainst, and the originals 12 are conveyed by a pair of conveying rollers 16*a* and 16*b* and discharged onto a discharge tray 17. Light is applied from a light source 18 to the surface of the original 12 while the original 12 is being conveyed, and the light reflected therefrom is caused to pass to a photoelectric conversion element 21 such as a CCD via a mirror 19 and a lens 20, and the image signal thereof is transmitted to the recording system of the recording apparatus in the case of the copy mode, and is transmitted to the recording system of another apparatus in the case of the transmission mode.

The operation panel C is a panel for performing operations such as the mode switching operation, the copying operation and the transmitting operation, and is provided with keys for the various operations. This operation panel C is provided on the upper portion of an original conveying mechanism in the reading system B, and is constructed for pivoted movement relative to the apparatus body 7. One side of the operation panel C is equipped with a telephone set D for effecting transmission and reception.

In FIG. 1B, the reference numeral 22 designates an electric equipment substrate and the reference numeral 23 denotes a power source unit.

The recording sheet 1 may be plain paper, plastic film or a sheet of any other material to which ink is transferable. In the present embodiment, a length of plain paper of B4 width or A4 width is used as the recording sheet 1. A sheet roll 1*a* comprising the recording sheet 1 wound into the form of a roll is contained in the roll holder 8 provided at a predetermined location in the apparatus body 7 (substantially at the center of FIG. 1B).

The recording sheet 1, after it unwinds may be curled. In order to eliminate such curl, a decurling shaft 43 is provided near that side of the roll holder 8 which is against to the platen roller 4. The decurling shaft 43 rotates in conformity with tension acting on the recording sheet 1, and is designed to cooperate with a guide shaft 24 which will be described later to eliminate the curl of the recording sheet 1.

The present embodiment, in order to achieve a reduction in the running cost, adopts the so-called multiprint system in which the recording sheet 1 and the ink sheet 2 are conveyed for recording with a velocity difference provided therebetween.

According to this multiprint system, recording is effected with the conveyed length of the ink sheet 2 being made shorter than the conveyed length L of the recording sheet 1 (L/n:n>1), and as compared with a conventional recording system in which the conveyed length of the recording sheet is made equal to the conveyed length of the ink sheet 2, the use efficiency of the ink sheet 2 is n times as high.

Accordingly, in the present embodiment, the ink sheet 2 is constructed, for example, of four layers as shown in FIG.

14 wherein an ink layer capable of transferring ink n times is provided on base film.

That is, the second layer is base film which provides a support for the ink sheet 2. In the case of multiprint, heat energy is applied to the same portion many times and therefore, the second layer may advantageously be aromatic polyamide film of high heat resisting property or condenser paper, but conventional polyester film will also stand use. The thickness of this layer may advantageously be as small as possible in respect of the quality of print from its role as a medium, and may desirably be 3 $\mu$m–8 $\mu$m because the strength of the film must be taken into consideration.

The third layer is an ink layer containing therein a quantity of ink which can be transferred n times to the recording sheet 1. The chief components of this layer are resin such as EVA as an adhesive agent, carbon black or nigrosine dye for coloring, and carnauba wax or paraffin wax as a binding material, and these components are combined so as to stand n times of use in the same portion. Sensitivity and density differ depending on the amount of application of this layer, which may desirably be about 4 g/m$^2$–8 g/m$^2$, although it can be chosen as desired.

The fourth layer is a top coating layer which is not involved with printing and which prevents the ink of the third layer from being pressure-transferred to the recording sheet 1, and is formed from transparent wax or the like. Thus, it is only the transparent fourth layer that is pressure-transferred, and ground staining of the recording sheet 1 can be prevented.

The first layer is a heat resistant coating layer for protecting the second layer, i.e., the base film, from the heat of the recording head 3 which is a thermal head. This heat resisting coat layer is suitable for multiprint in which heat energy for n lines may be applied to the same portion (when black information is continuous), but whether it should be used or not can be suitably chosen. Also, it is particularly effective for base film of relatively low heat resisting property such as polyester film.

The construction of the ink sheet 2 is not limited to what has been described above, but may also be an ink sheet comprising, for example, a base layer and a porous ink retaining layer provided on one side of the base layer and containing ink therein, or an ink sheet comprising base film and a heat resistant ink layer having a minute porous net-like structure provided on the base film, the ink layer containing ink therein. The material of the base film may be, for example, film of polyimide, polyethylene, polyester, polyvinyl chloride, triacetyl cellulose, nylon or the like, or paper. Further, the heat resistant coating layer is not always necessary, but the material thereof may be, for example, silicon resin, epoxy resin, fluorine resin, etholocellulose or the like.

Also, as an example of the ink sheet 2 having heat-sublimated ink, mention may be made of an ink sheet comprising a substrate formed of polyethylene terephthalate, polyethylene naphthalate, aromatic polyamide film or the like, and a color material layer provided thereon and formed of guanamine resin and fluorine resin and containing spacer particles and dyestuff.

The constructions of an ink sheet reel, a cartridge having the ink sheet reel, and a recording apparatus using these will hereinafter be described.

In the recording apparatus A, a supply reel 25 and a take-up reel 26 constructed as will be described later are independently mounted in the recording cover 11 as the loading portion, and the ink sheet 2 wound on the supply reel 25 is taken up onto the take-up reel 26, whereby the sheet 2 can be conveyed to carry out image formation.

Figure 4:
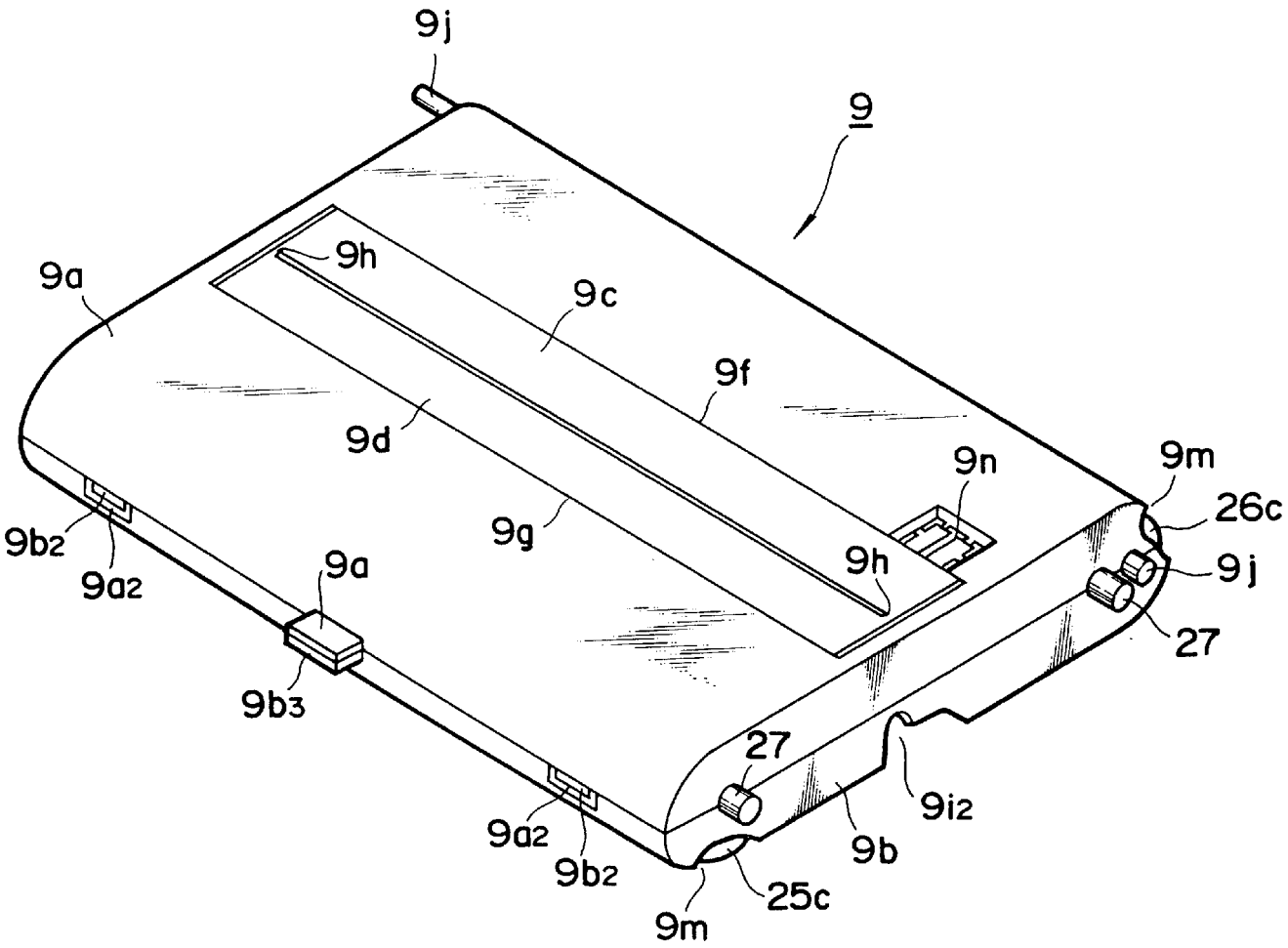
Figure 5:
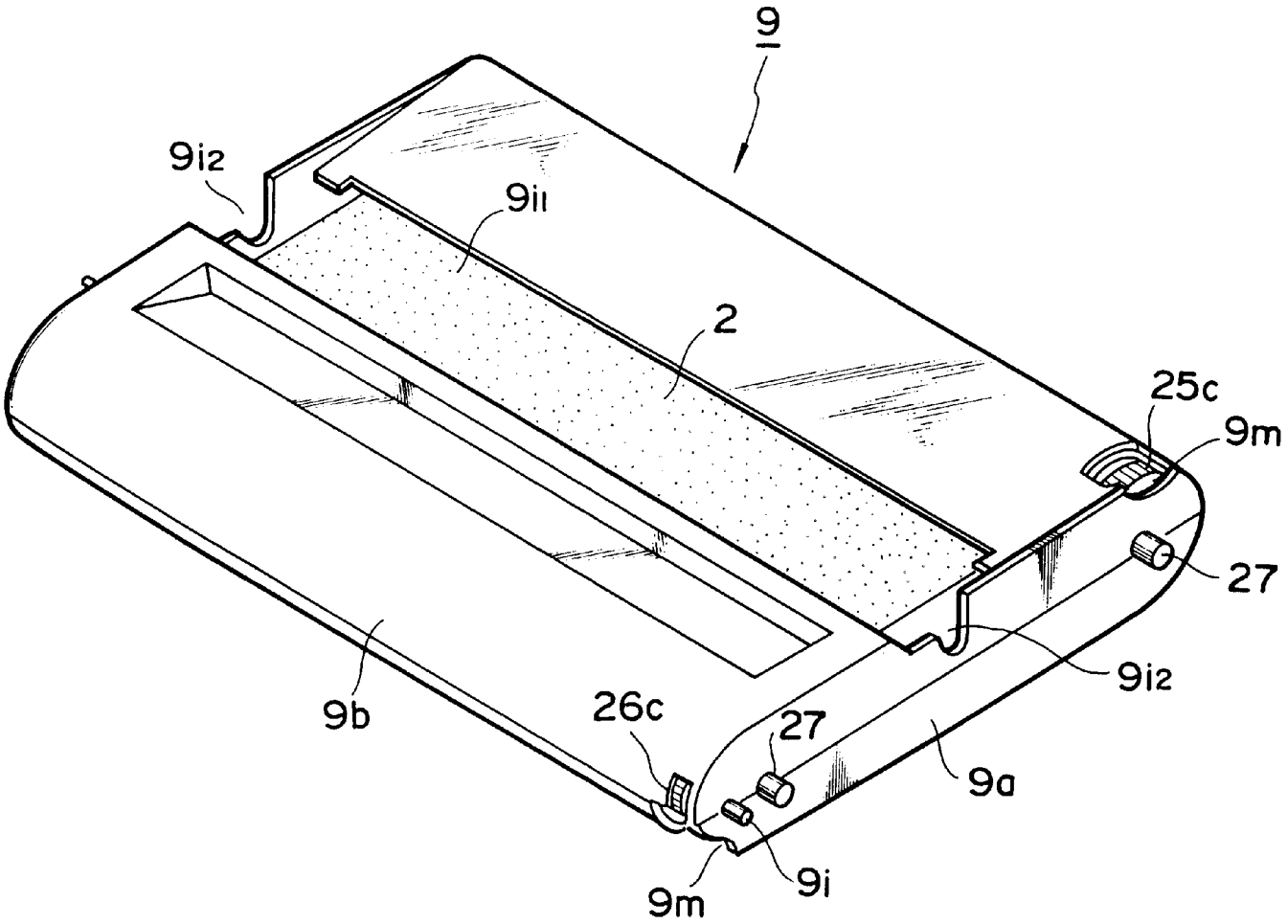
Figure 6A:
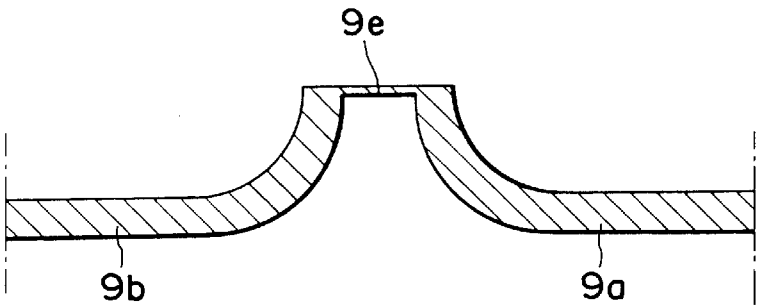
Figure 6B:
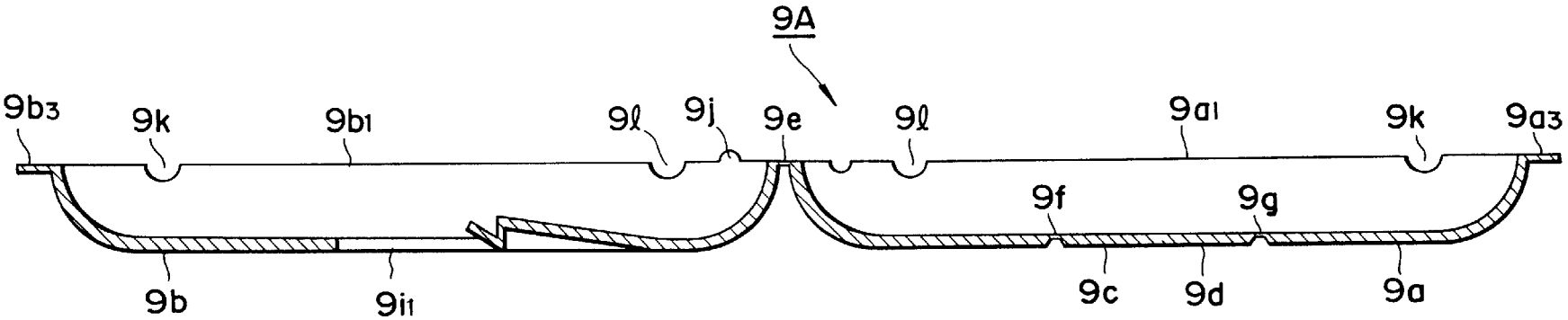

However, the ink sheet 2 in the present embodiment is loaded and held in a cartridge 9A (the cross-section of which is shown in FIG. 6B) as the frame member of an ink cartridge 9 constructed as shown in FIGS. 3 to 6A–6B. FIG. 6A is an enlarged cross-sectional view of the central portion of the cartridge 9A of FIG. 6B.

The ink cartridge 9 is constructed with the supply reel 25 and the take-up reel 26 being mounted at predetermined locations in the cartridge 9A as the frame member and with the ink sheet 2 wound on the supply reel 25 being extended onto the take-up reel 26 side to thereby load the cartridge with the ink sheet 2. By using this ink cartridge 9, the loading of the recording apparatus A with the ink sheet 2 can be very easily and reliably accomplished in a stable state.

The cartridge 9A in the present embodiment is molded as a unit of plastic, whereby the number of parts and the assembling cost are reduced.

As shown, the cartridge 9A has a first housing 9*a*, a second housing 9*b* and doors 9*c*, 9*d* molded as a unit by plastic molding.

That is, as shown in FIG. 6 which is a cross-sectional view of the cartridge 9A, a thin-walled portion 9*e* formed with a thickness smaller than the thickness of the first housing 9*a* and the second housing 9*b* is provided in the connecting portion between the two housings 9*a* and 9*b*, and similar thin-walled portions 9*f* and 9*g* are provided in the connecting portions between the first housing 9*a* and the doors 9*c* and 9*d* formed substantially centrally of the housing 9*a*. The doors 9*c* and 9*d* are connected together by a moustache-like connecting piece 9*h*.

The thin-walled portion 9*e* is constructed so as to serve as a hinge when the first housing 9*a* and the second housing 9*b* are closed in opposed relationship with each other after the supply reel 25 and the take-up reel 26 are inserted into the cartridge 9A. Also, the thin-walled portions 9*f* and 9*g* are constructed so as to serve as hinges when the doors 9*c* and 9*d* are opened by fork members 3*c* provided on both sides of the recording head 3 shown in FIG. 2 when the ink cartridge 9 has been mounted in the recording apparatus A.

The thin-walled portions 9*e*–9*g* have flexibility and moderate strength. That is, the thicknesses of the thin-walled portions 9*e*–9*g* are set to appropriate dimensions in conformity with the plastic material used.

The thin-walled portions 9*e*–9*g* may be formed over the full length and may be intermittently formed with predetermined lengths.

The moustache-like connecting piece 9*h* (see FIGS. 3 and 4) connecting the doors 9*c* and 9*d* together serves to keep the doors 9*c* and 9*d* closed and prevent dust from entering the interior of the ink cartridge 9 when the cartridge 9 is not used. Also, the form members 3*c* provided on the recording head 3 are formed with such dimensions that when loading the recording apparatus A with the ink cartridge 9, the fork members 3*c* bear against the doors 9*c* and 9*d* to thereby easily break away the doors 9*c* and 9*d* when the doors are opened.

The molding material of the cartridge 9A may be resin such as polypropylene resin or ABS resin.

In the cartridge 9A, a window 9*i*, for inserting the platen roller 4 therethrough is formed substantially centrally of the second housing 9*b* and a cut-away $9i_2$ for permitting the shaft portion 4*b* of the platen roller 4 to escape is formed continuously to the window $9i_1$.

Side plates $9a_1$ and $9b_1$ are formed upright on both sides of the first housing 9*a* and the second housing 9*b*, and the portions thereof which are adjacent to the thin-walled portion 9*e* and the open side are formed with curved surfaces of square circle. Also, in the open side curved surface, engagement recesses $9a_2$ are formed on the first housing 9*a* side, and restraining projections $9b_2$ for engagement with the engagement recesses $9a_2$ are formed on the second housing 9*b* side. Further, in the open side curved surfaces of the first housing 9*a* and the second housing 9*b*, there are formed restraining projections $9a_3$ and $9b_3$ adapted to be engaged with a restraining spring 41 provided on the recording cover 11 when the ink cartridge 9 is mounted in the recording cover 11.

At predetermined locations on the side plates $9b_1$ of the second housing 9*b*, there are formed guide pins 9*j* which provide guides when the ink cartridge 9 is mounted in the recording cover 11.

At predetermined locations on the side plates $9a_1$ and $9b_1$, there are formed U-grooves 9*k* for loosely fitting therein bearings 27 mounted on the supply reel 25 and u-grooves 9*l* for loosely fitting therein bearings 27 mounted on the take-up reel 26. Also, the first housing 9*a* and the second housing 9*b* are formed with openings 9*m* through which the reel gear 25*c* of the supply reel 25 and the reel gear 26*c* of the take-up reel 26 may be exposed.

In FIG. 4, the reference character 9*n* designates an identifying portion adapted to contact a sensor 50 provided in the recording cover 11 when the ink cartridge 9 is mounted in the recording cover 11, and identify the presence or absence of the ink cartridge 9 or the size or the like of the ink sheet 2 loaded in the ink cartridge 9, by the sensor 50.

Figure 3:
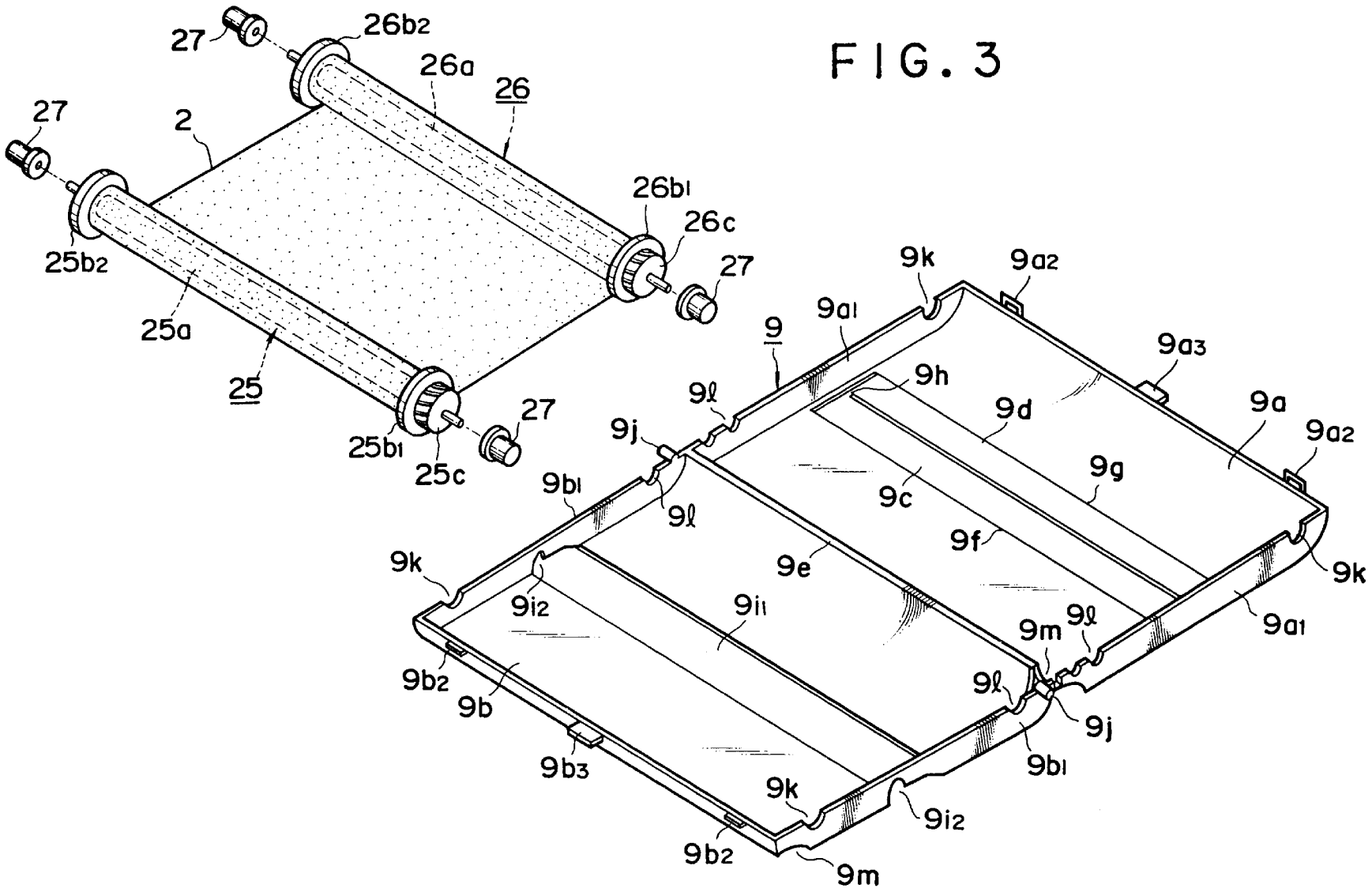

The supply reel 25 and the take-up reel 26, as shown in FIG. 3, have reel shafts 25*a* and 26*a*, respectively, having a longer dimension than the width dimension of the ink cartridge 9. Flanges $25b_1$, $25b_2$, $26b_1$ and $26b_2$ each having a length substantially equal to the internal dimension of the ink cartridge 9 are provided on the reel shafts 25*a* and 25*b*, Reel gears 25*c* and 26*c* serve as means for transmitting the motive power and are integrally formed on the flanges $25b_1$ and $26b_1$, respectively.

In the present embodiment, the reel gears 25*c* and 26*c* are helical gears, and the torsional direction of the teeth of these reel gears 25*c* and 26*c* is the direction from the flanges 25*b*, 26*b*, toward the flanges $25b_2$, $26b_2$, i.e., the direction in which a thrust can be created in the reel shafts 25*a* and 26*a* at one axial end thereof.

Also, the opposite ends of the reel shafts 25*a* and 26*a* are constructed so as to protrude outwardly of the reel gears 25*c*, 26*c*, and the flanges $25b_2$, $26b_2$. The bearings 27 are rotatably mounted on these protruding ends. Accordingly, the reels 25 and 26 are loosely fitted in the grooves 9*k* and 9*l* through the bearings 27 when the reels 25 and 26 are mounted in cartridge 9A of the ink cartridge 9. The bearings 27 protrude from the cartridge 9A of the ink cartridge 9 and are fitted into bearing grooves 39*a*, 39*b*, 40*a* and 40*b* formed in the apparatus body 7 of the recording apparatus A.

Description will now be made of a case where the ink sheet 2 is inserted into the cartridge 9A 1constructed as described above to thereby manufacture the ink cartridge 9.

With the cartridge 9A opened as shown in FIG. 3, the supply reel 25 having the ink sheet 2 thereon and having the bearings 27 mounted on the opposite ends thereof is mounted in the U-grooves 9*k* of the second housing 9*b*. Also, the take-up reel 26 having the bearings 27 mounted on the opposite end thereof is mounted in the U-grooves 9*l*. Then, the leading end of the ink sheet 2 is drawn out from the supply reel 25 and is attached to the reel shaft 26*a* of the take-up reel 26 as by an adhesive tape. Thereafter, the first housing 9*a* is bent about the thin-walled portion 9*e* and opposed to the second housing, and the engagement projections $9b_2$ are brought into engagement with the engagement recesses $9a_2$, whereby the ink cartridge 9 loaded with the ink sheet 2 as shown in FIGS. 4 and 5 can be manufactured.

The ink cartridge 9 is mounted in the recording cover 11 through a mounting groove 28 constructed as will be described later.

A recording unit is constituted by the recording head 3 and the platen roller 4. The recording head 3 and the platen roller 4 are disposed in opposed relationship with each other. The recording head 3 is pivotably provided in the recording cover 11, and the platen roller 4 is rotatably provided in the apparatus body 7.

In the case of the present embodiment, the recording head 3 is a thermal head having a plurality of heat generating elements, and is pivotably mounted on a head supporting portion 3*a* provided in the recording cover 11. Also, the recording head 3 is biased toward the platen roller 4 by a spring 3*b* disposed between the head 3 and the recording cover 11. By this biasing force, the recording sheet 11 and the ink sheet 2 overlapping with each other are urged against the platen roller 4.

Fork members 3*c* are provided on both sides of the recording head 3. These fork members 3*c* open the doors 9*c* and 9*d* formed on the ink cartridge 9 when the cartridge 9 is mounted in the recording cover 11, and have the positioning function for engaging the shaft portion 4*b* of the platen roller 4 and thereby setting the position of the recording head 3 relative to the platen roller 4.

The platen roller 4 is provided downstream with respect to the direction of conveyance of the recording sheet 1, as shown in FIG. 1B. The platen roller 4 is formed with a roller portion 4*a* conforming to the width dimension of the recording sheet 1 (see FIGS. 2A and 2B). Shaft portions 4*b* are formed at the opposite ends of the roller portion 4*a*, and the fork members 3*c* provided on the recording head 3 are engageable with the shaft portions 4*b*.

The platen roller 4 is driven by the drive force of a motor 29. The motor 29 is secured to a side plate 7*a* of the apparatus body 7. The rotation of the motor 29 is transmitted to the platen roller 4 through power transmission gears 30*a*–30*c*. When carrying out image formation on the recording sheet 1, the platen roller 4 is rotated in the direction of arrow as shown in FIG. 1B to thereby convey the recording sheet 1 in the direction of arrow a, and after the recording sheet 1 is cut by the cutter 5, the platen roller 4 is rotated in the direction opposite to the direction of arrow to thereby convey the recording sheet 1 in the direction opposite to the direction of arrow a.

The apparatus body 7 in which the platen roller 4, etc. are provided is formed into a lateral U-shape having rigidity as shown in FIG. 2. The apparatus body 7 is formed with side plates 7*a* and 7*b* on the opposite sides thereof, and the side plates 7*a* and 7*b* are connected together by a partition plate 7*c*. The partition plate 7*c* has the function of spacing the recording apparatus A and the reading system B apart from each other.

The recording cover is mounted on the apparatus body 7 through a pivot shaft 10 so that it can be opened and closed.

In the present embodiment, the pivot axis of the recording cover 11 relative to the apparatus body 7 is-positioned at the end thereof which is adjacent to the original supporting table 13 formed on top of the recording cover 11 and which is sideways of the operation panel C.

That is, as shown in FIGS. 7 to 9A and 9B, the recording cover 11 has its upper surface constructed as the original supporting table 13, which is formed with an inclined portion 13*a* downwardly inclined toward the reading system B. It is also constructed so that the horizontal portion 13*b* of the original supporting table 13 may be substantially flush with the upper surface of the operation panel C.

Figure 7:
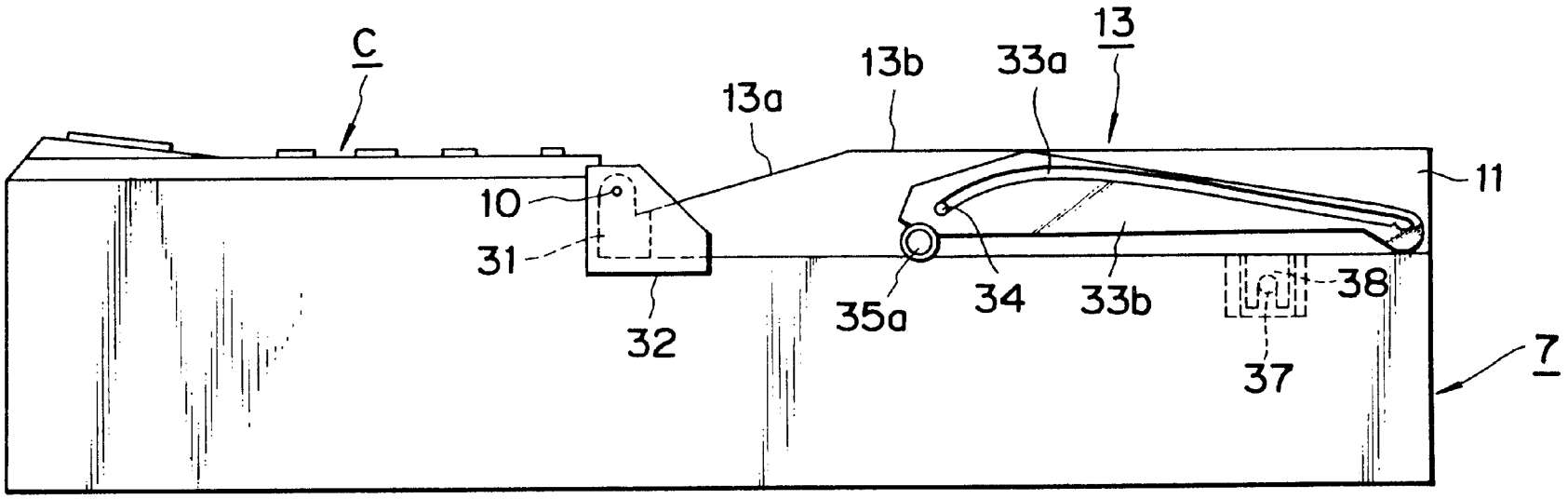
FIG. 7 illustrates a recording cover as it is closed.
Figure 8:
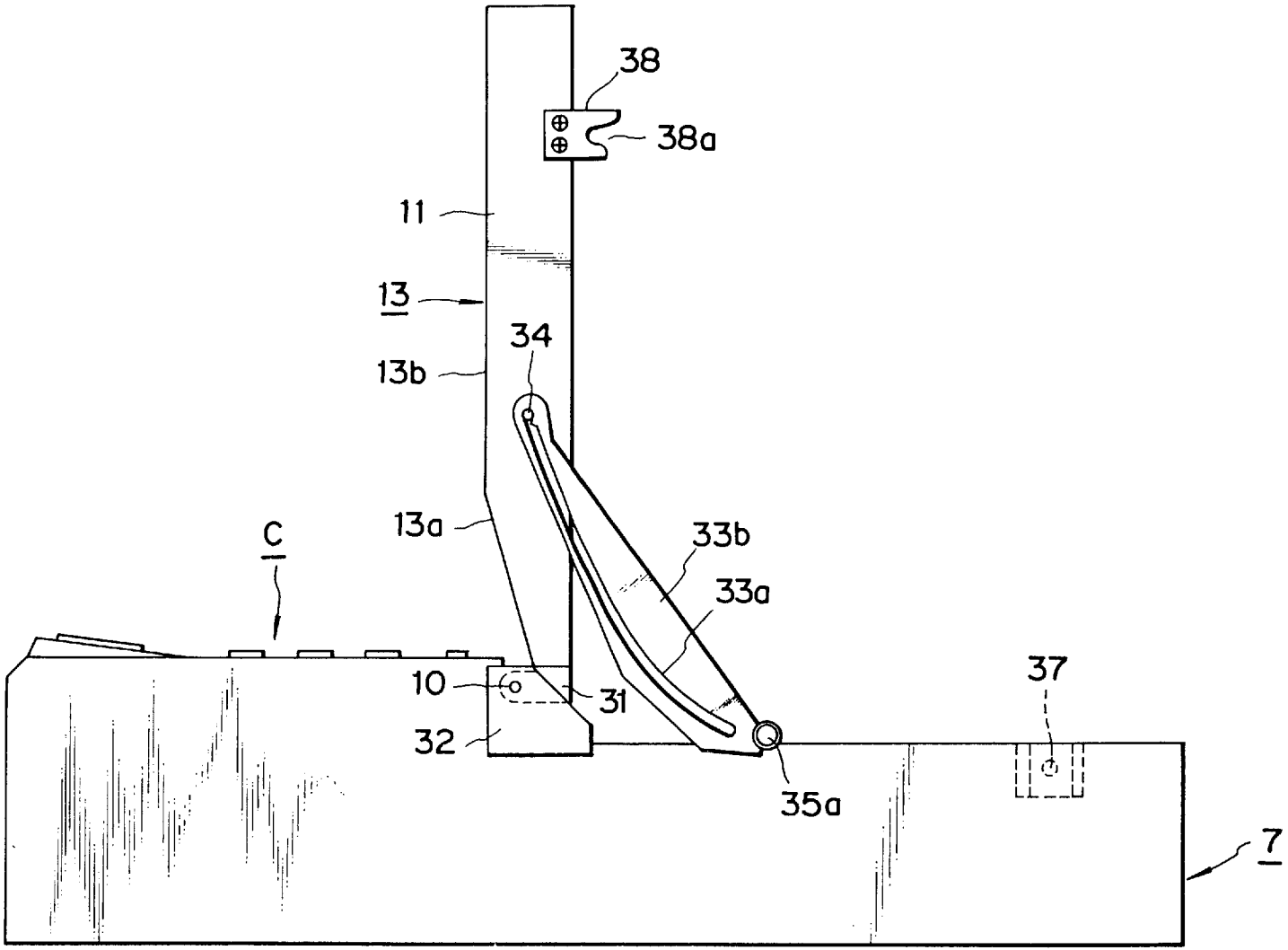
FIG. 8 illustrates the recording cover as it is opened.
Figure 9B:
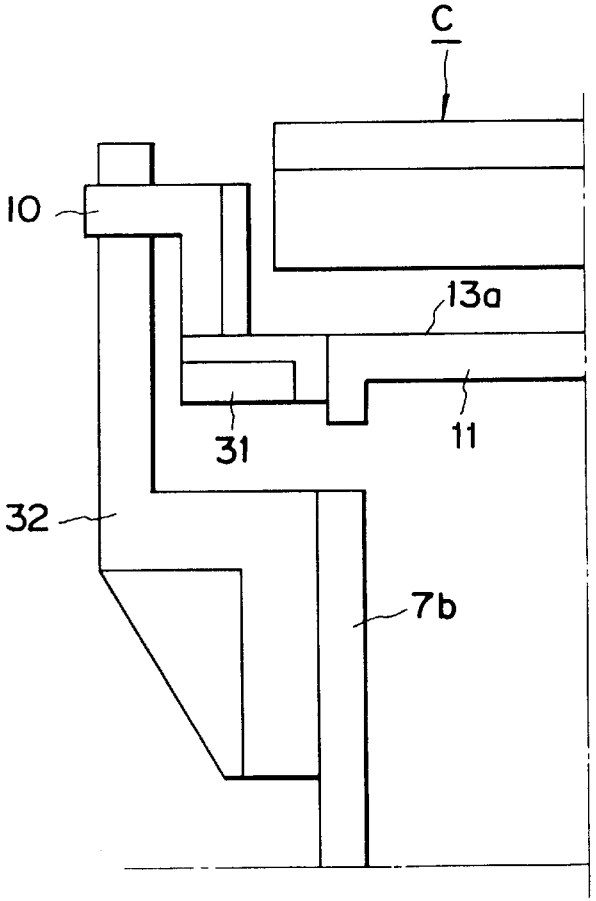
FIGS. 9A and 9B illustrate the mounting of the recording cover with respect to the apparatus body.
Figure 9A:
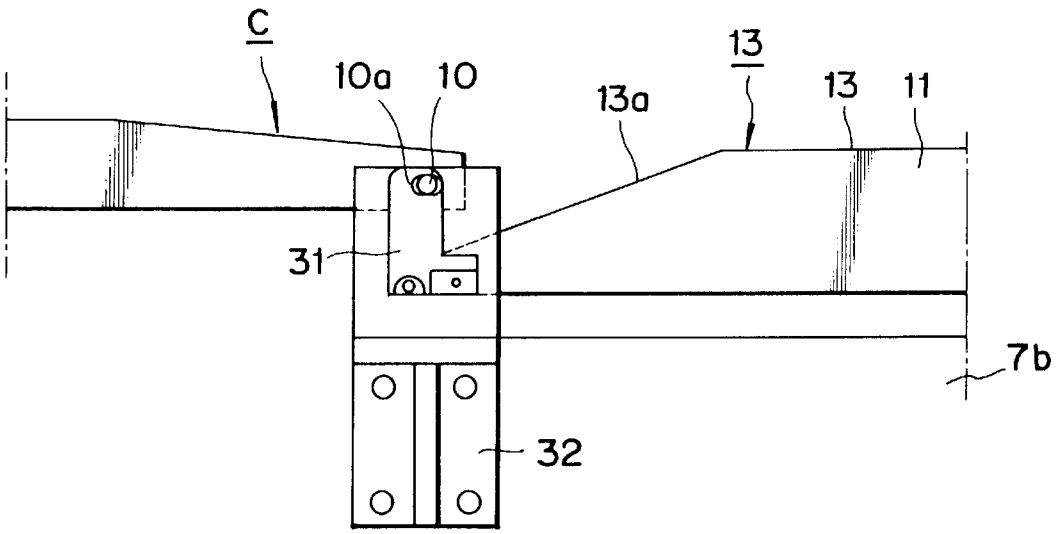

At the end of the recording cover 11 which is adjacent to the reading system B, i.e., the end of the inclined portion 13*a* of the original supporting table 13 as shown in FIGS. 7 and 8, there is provided a shaft member 31 having pivot shafts 10 on the opposite sides thereof. This shaft member 31 is constructed so as to protrude to that side of the recording cover 11 which is adjacent to the original supporting table 13 and to position the pivot shafts 10 sideways of the operation panel C. The inclined portion 13*a* is provided with a slider 13*c* for guiding the original 12, the slider 13*c* being slidable in accordance with the size of the original 12.

A pair of opposed brackets 32 are secured to the ends of the side plates 7*a* and 7*b* of the apparatus body 7 which are adjacent to the partition plate 7*c*. These brackets 32 provide a support portion for pivotably supporting the recording cover 11 relative to the apparatus body 7. For this purpose, as shown in FIG. 9, each bracket 32 is formed with a pivot hole 10*a* for inserting thereinto a pivot shaft 10 provided on the recording cover 11. The pivot hole 10*a* may be a round hole, but in the present embodiment, it is in the form of a slot in which the recording cover is longitudinally movable relative to the apparatus body 7.

The brackets 32, as shown in FIGS. 7 and 8, are constructed so as to position the pivot holes 10*a* formed therein at the sideways end of the operation panel C which is adjacent to the original supporting table 13. That is, they are constructed so as to position the pivot axis of the recording cover 11 at the sideways end of the operation panel C which is adjacent to the original supporting table 13.

By fitting the pivot shaft 10 of the recording cover 11 into the pivot holes 10*a* formed in the brackets 32, it becomes possible to mount the recording cover 11 on the apparatus body 7 so that it can be opened and closed, thereby positioning the pivot axis of the recording cover 11 at the sideways end of the operation panel C which is adjacent to the original supporting table 13.

By the pivot axis of the recording cover 11 relative to the apparatus body 7 being positioned at the sideways end of the operation panel C which is adjacent to the original supporting table 13 as described above, the end portion of the operation panel C and the end portion of the original supporting table 13 do not interfere with each other when the recording cover 11 is opened. Therefore, it becomes possible to dispose the operation panel C close to the original supporting table 13 and accordingly, it becomes possible to shorten the full length of the apparatus.

When the recording cover 11 is closed, a weight acting on the center of gravity of the recording, cover 11 and a rotational torque conforming to the horizongal distance from the pivot shaft 10 to the center of gravity act on the pivot shaft 10. Accordingly, when the recording cover 11 is caused to fall freely from its open position, a shock may be created by the action of said rotational torque when the cover 11 is closed.

So, in the present embodiment, a torsion coil spring 36 is mounted on a shaft portion 33*c* provided on a cover stay 33 for maintaining the open position of the recording cover 11 so that a braking force may be created by the spring 36.

Figure 10:
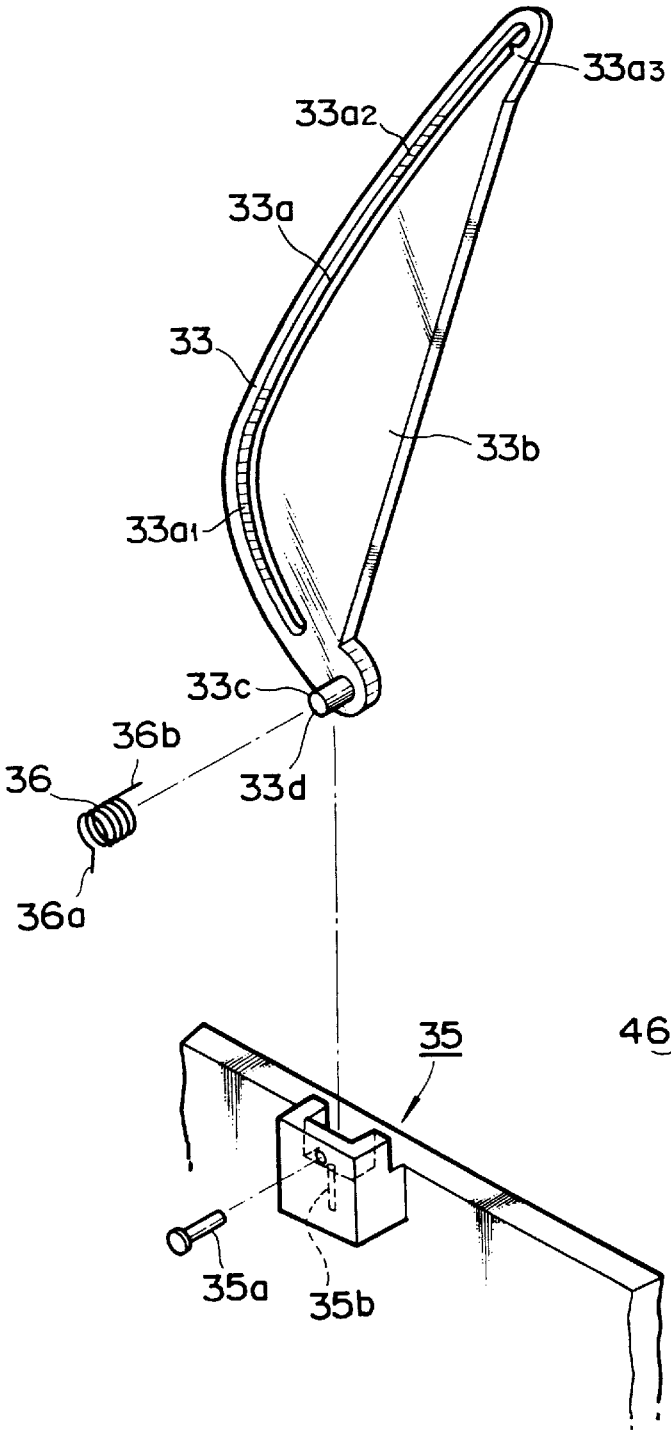
FIG. 10 illustrates a cover stay.
Figure 11B:
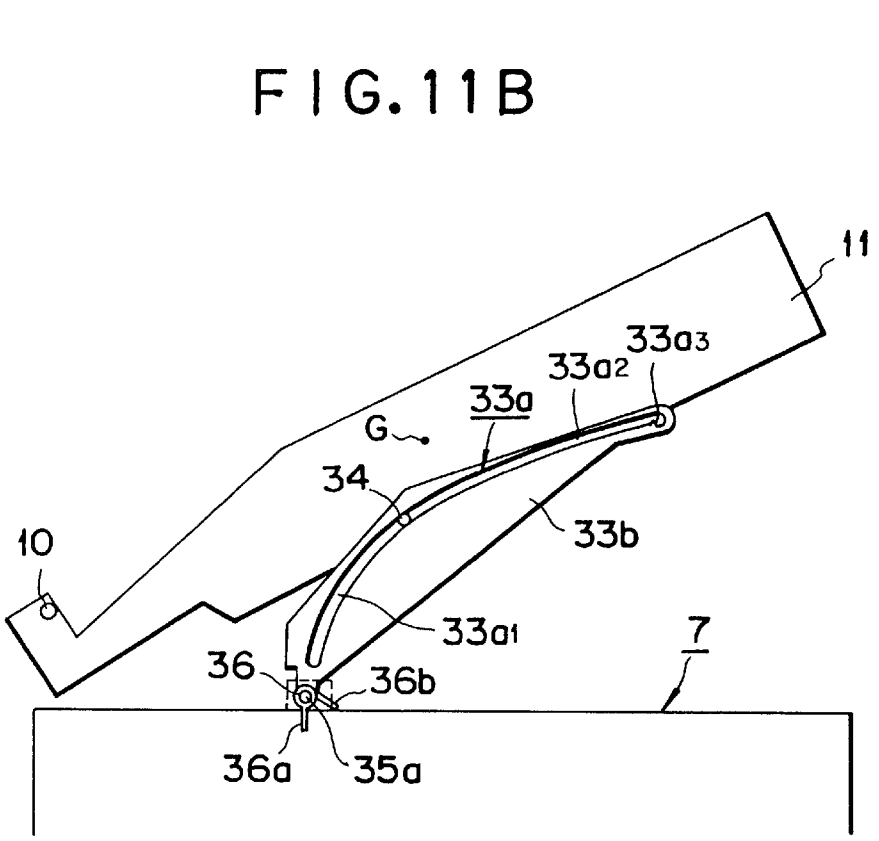
FIGS. 11A and 11B illustrate the operation of the cover stay.
Figure 11A:
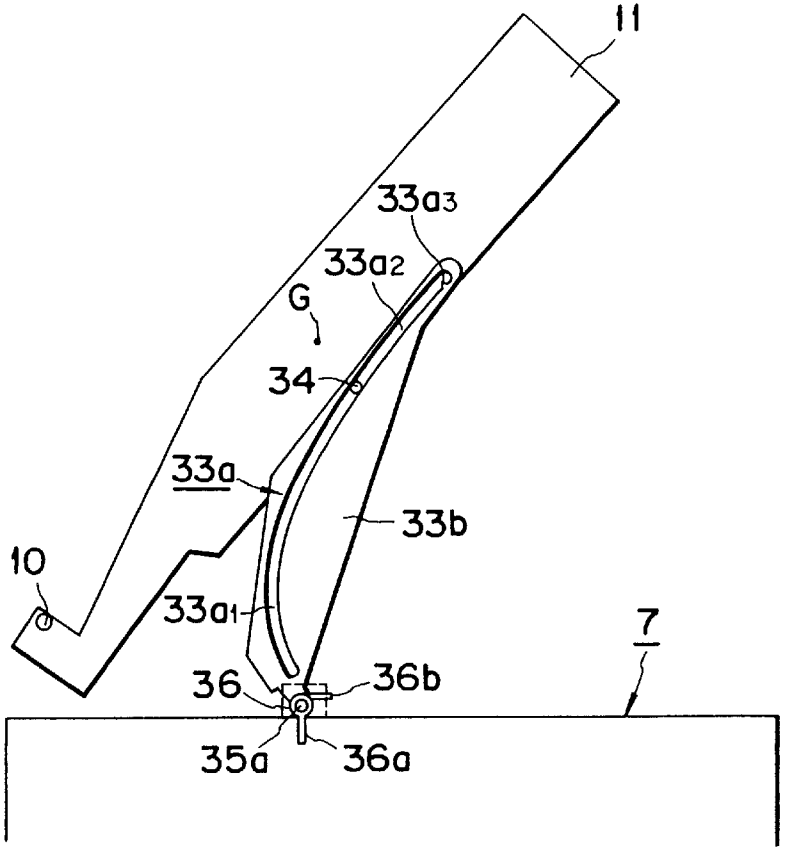

That is, as shown in FIGS. 10 and 11A and 11B, the cover stay 33 is pivotably mounted on the side plate 7*b* of the apparatus body 7 and a pin 34 is provided on the recording cover 11.

The cover stay 33 is mounted on a mounting portion 35 provided on the side plate 7*b*. The location of the mounting portion 35 is closer to the center of gravity G of the recording cover 11 than to the pivot shaft 10 which is the pivot axis of the recording cover 11 relative to the apparatus body 7. The pin 34 is provided near the center of gravity of the recording cover 11.

The cover stay 33 is constituted by a plate member 33*b* formed with a groove 33*a* and a shaft portion 33*c* for mounting the torsion coil spring 36 thereon. The groove 33*a* is such that an arcuate groove $33a_1$ is formed near the shaft portion 33*c* and a substantially straight groove $33a_2$ is formed continuously to the arcuate groove $33a_1$. The pin 34 provided on the recording cover 11 is fitted in the goove 33*a*, and the rotational force of the recording cover 11 is transmitted to the cover stay 33 through the pin 34. A projection $33a_3$ formed at one end of the groove $33a_2$ is for engaging the pin 34 to thereby maintain the open position of the recording cover 11.

A through-hole 33*d* is formed axially through the shaft member 33*c*. By the cover stay 33 being fitted to a shaft 35*a* provided in the mounting portion 35 through the through-hole 33*d*, the stay 33 is mounted on the apparatus body 7 for pivotal movement about the shaft 35*a*.

The torsion coil spring 36 is mounted around the shaft member 33*c*. One arm 36*a* of the torsion coil spring 36 is inserted in a groove 35*b* formed in the mounting portion 35 and is fixed to the apparatus body 7, and the other arm 36*b* is a free end. The torsion coil spring 36 is mounted on the shaft member 33*c* in such a manner that it is freely tightened when the cover stay 33 pivots in a direction to close the recording cover 11 and it is freely loosened when the cover stay 33 pivots in a direction to open the recording cover 11. The inner diameter of the torsion coil spring 36 is made substantially equal to or slightly smaller than the outer diameter of the shaft member 33*c*. Accordingly, a frictional load is always acting between the torsion coil spring 36 and the shaft member 33*c*.

By the pin 34 provided on the recording cover 11 being fitted in the groove 33*a* in the cover stay 33 constructed as described above, it is possible to create a braking force by the torsion coil spring 36 when the recording cover 11 is closed.

That is, while shift is made from the open position of the recording cover 11 shown in FIG. 8 to the closed position of the recording cover 11 shown in FIG. 7 (that is, while the recording cover 11 is shifted by uniform angular velocity motion from its open position to its closed position), the pin 34 comes into engagement with the groove $33a_2$ in the cover stay 33 as shown in FIG. 11A. At this time, with the pivotal movement of the recording cover 11, the cover stay 33 rotates, but this angle of rotation is not great because the groove $33a_2$ is straight. When the pivotal movement of the recording cover 11 progresses and the pin 34 comes into engagement with the arcuate groove $33a_1$ as shown in FIG. 11B, the angle of rotation of the cover stay 33 becomes greater. Accordingly, the frictional load between the torsion coil spring 36 and the shaft member 33*c* becomes greater and the spring 36 is freely tightened, whereby a braking force acts on the cover stay 33. At this time, the rotational torque acting on the shaft portion 33*c* of the cover stay 33 becomes smaller than the rotational torque acting on the pivot shaft 10 of the recording cover 11 and accordingly, it is possible to make the rigidity of the torsion coil spring 36 small.

The recording apparatus A of the present embodiment uses the heat transfer system. As previously described, this recording system is such that the recording sheet 1 and the ink sheet 2 are made to overlap with each other and the ink sheet 2 is heated in the form of an image pattern from the support sheet thereof, whereby the ink is melted and transferred to the recording sheet 1 to thereby form an image thereon. Therefore, the adhering force of the melted ink acts between the recording sheet 1 and the ink layer. The conveying force acting on the recording sheet 1 is transmitted to the recording cover 11 by said adhesion force through the ink sheet 2, and a force acts to move the cover 11 in the direction of conveyance of the recording sheet 1.

When image formation is being normally carried out, the ink is melted and therefore, the adhesion force is small and poses no problem. However, if during image formation, the melted ink solidifies for some reason or other with the recording sheet 1 and the ink sheet 2 overlapping with each other, an increased adhering force will be created, whereby the recording cover 11 may be moved in the direction of conveyance of the recording sheet 1.

Therefore, in the present embodiment, the recording cover 11 is fixed to the apparatus body 7 so that the recording cover 11 may not be moved in the longitudinal direction.

That is, as shown in FIGS. 7 and 8, a shaft 37 is provided on the side plates 7*a* and 7*b* of the apparatus body 7 downstream with respect to the direction of conveyance of the recording sheet 1. This shaft 37 is disposed with a predetermined degree of parallelism relative to the axial direction of the platen roller 4.

On the opposite sides of the recording cover 11, a pair of restraining member 38 are secured at a location opposed to the shaft 37. Each of these restraining members 38 is formed into a fork-like shape having a U-groove 38*a* engaged by the shaft 37. The inner diametrical dimension of the U-groove 38 is designed with a predetermined tolerance of engagement relative to the outer diametrical dimension of the shaft 37. A line passing through the centers of the pair of U-grooves 38*a* is disposed parallel to the supply reel 25 and the take-up reel 26 for the ink sheet 2. By bringing the restraining members 38 into engagement with the shaft 37 when the recording cover 11 is closed relative to the apparatus body 7, the recording cover 11 is accurately positioned relative to the apparatus body 7 and the movement of this cover 11 in the longitudinal direction is prevented.

In the above-described construction, the adhering force created between the recording sheet 1 and the ink layer is transmitted to the recording cover 11 through the ink sheet 2 and is further transmitted to the apparatus body 7 through the restraining members 38 and the shaft 37. At this time, the restraining members 38 and the shaft 37 fit together with a predetermined tolerance and thus, the recording cover 11 is not moved in the longitudinal direction.

Description will now be made of the construction of the loading portion of the recording cover 11 which is removably loaded with the ink cartridge 9 and the construction of the gear portion of the conveying system for conveying the ink sheet 2 in the ink cartridge 9.

In the present embodiment, the ink cartridge 9 is mounted in the recording cover 11 at the loading portion and the cover 11 is closed, whereby the longitudinal positions and the vertical positions of the reels 25 and 26 can be set by bearing grooves 39*a*, 39*b*, 40*a*, 40*b* and a support member 42, and by a thrust being caused to act on the reels 25 and 26, the lateral positions of the reels 25 and 26 can be set.

The construction of the portion which is loaded with the ink cartridge 9 will first be described specifically. A mounting groove 28 for removably loading the loading portion with the ink cartridge 9 is provided in opposed relationship with both sides of the recording cover 11, as shown in FIG. 2. This mounting groove 28 is formed by a hook-shaped groove to restrain the guide pin 9*j* of the ink cartridge 9. On both sides of the recording cover 11, U-shaped bearing grooves 39*a*, 39*b*, 40*a* and 40*b* fitted to the bearings 27 fitted to the opposite ends of the reels 25 and 26 to position the bearings 27 are opposedly provided on the same extension at a predetermined interval. The bearing grooves 39*a* and 40*a* are formed as U-grooves extending through the recording cover 11, and the bearing grooves 39*b* and 40*b* are formed as U-grooves having their axial ends closed. Also, a restraining spring 41 for restraining the restraining projection $9b_3$ of the ink cartridge 9 is provided near the open end side of the recording cover 11.

Support members 42 are provided on the side plates 7*a* and 7*b* of the apparatus body 7 which are opposed to the bearing grooves 39*a*, 39*b*, 40*a* and 40*b* formed in the recording cover 11. The support members 42 bear against the bearings 27 fitted to the opposite ends of the reels 25 and 26 and bias the bearings 27 toward the bearing grooves 39*a*, 39*b*, 40*a* and 40*b*, thereby maintaining the positions of the reels 25 and 26 relative to the recording cover 11. Each of the support members 42 is comprised of a case 42*a* secured to the side plate 7*a*, 7*b*, a support piece 42*b* having one end thereof contained in the case 42*a* and the other end having a contact surface with respect to the bearing 27, and a spring contained in the case 42*a*.

Accordingly, the guide pin 9*j* of the ink cartridge 9 is fitted in and restrained by the hook-shaped groove 28*a*, the ink cartridge 9 is rotated about the guide pin 9*j* and the restraining projection $9b_3$ is restrained by the restraining spring 41, whereby the ink cartridge 9 is mounted in the recording cover 11. At this time, the bearings 27 fit in the respective bearing grooves 39*a*, 39*b*, 40*a* and 40*b*. When the recording cover 11 is closed, the bearings 27 are supported by the support pieces 42*b* of the support members 42 and are biased toward the bearing grooves 39*a*, 39*b*, 40*a* and 40*b*, whereby the reels 25 and 26 have their mounted positions relative to the recording cover 11 set.

Also, when the ink cartridge 9 is to be mounted in the recording cover 11 as previously described, it is possible to cause the cartridge 9 to bear against the guide shaft 24 rotatably provided in the recording cover 11 as shown in FIG. 1, and insert the cartridge along this guide shaft 24. Also, when the guide pin 9*j* of the ink cartridge 9 is fitted into the mounting groove 28 shown in FIG. 2 and thereafter the ink cartridge 9 is rotated, the fork members 3*c* provided on both sides of the recording head 3 bear against the doors 9*c* and 9*d* of the ink cartridge 9 and break away and open the "moustache-like" connecting piece 9*h* connecting the doors 9*c* and 9*d* together, whereby the recording head 3 is inserted into the ink cartridge 9.

When the ink cartridge 9 is mounted in the recording cover 11 in the manner described previously, the longitudinal positions of the reels 25 and 26 are set by the bearing grooves 39*a*, 39*b*, 40*a* and 40*b*. Also, when the recording cover 11 is closed relative to the apparatus body 7, the vertical positions of the reels 25 and 26 are set by the bearing grooves 39*a*, 39*b*, 40*a*, 40*b* and the support members 42.

Also, when the ink cartridge 9 is mounted in the recording cover 11, the sensor 50 provided in the cover 11 bears against the identifying portion 9*n* of the ink cartridge 9 so as to be able to detect the presence or absence of the ink cartridge 9 or the size or the like of the ink sheet 2 inserted in the ink cartridge 9.

Description will now be made of the gear portion of the power transmitting means of the conveying system for the ink sheet 2.

When the ink cartridge 9 is mounted in the recording cover 11, the reel gear 26*c* of the take-up reel 26 may come into meshing engagement with a drive force transmitting gear 44*a* (see FIG. 13) constituting a driving mechanism 44 for the take-up reel 26 provided in the recording cover 11 and the reel gear 25*c* of the supply reel 25 may come into meshing engagement with a tension transmitting gear 45*a* constituting a back tension imparting mechanism 45 provided in the apparatus body 7 as shown in FIG. 2.

The reel gears 25*c* and 26*c* of the reels 25 and 26 are constructed of helical gears as previously described (see FIG. 3). The drive force transmitting gear 44*a* and tension transmitting gear 45*a* on the recording cover 11 side which mesh with the reel gears 25*c* and 26*c* are likewise constructed of helical gears.

Figure 12A:
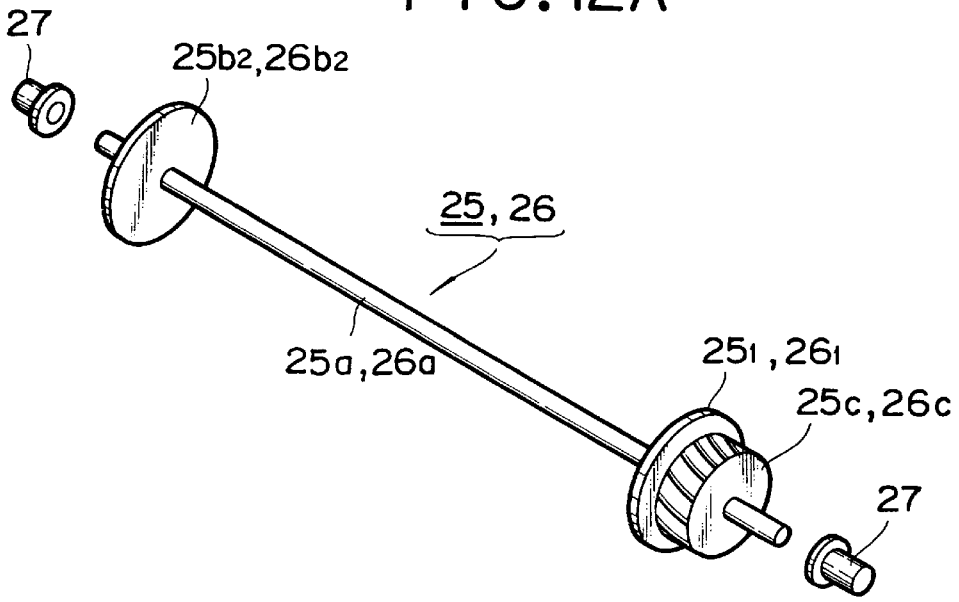
FIGS. 12A and 12B illustrates a take-up reel mounted on the recording cover.
Figure 12B:
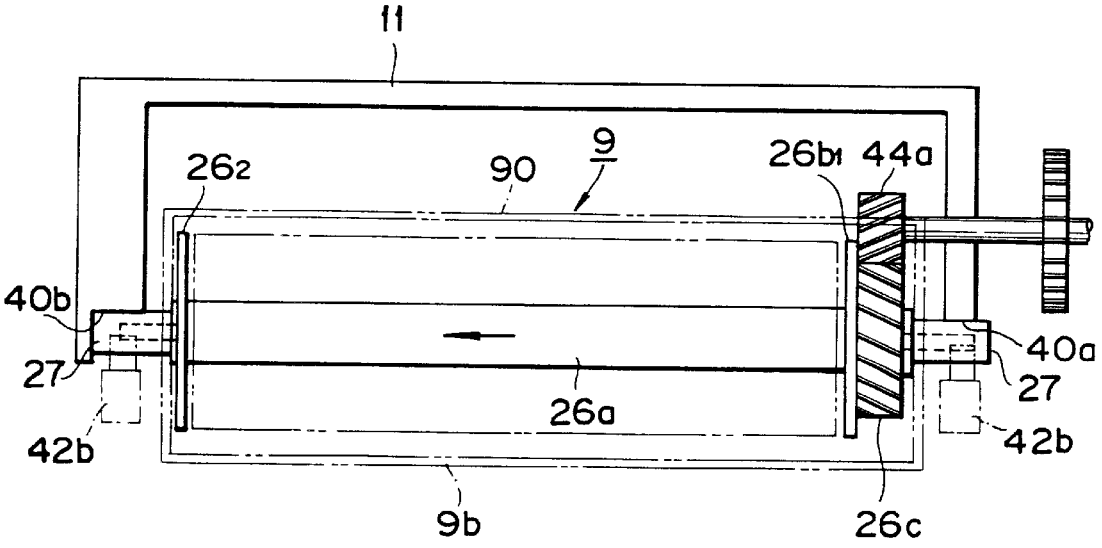
Figure 14:
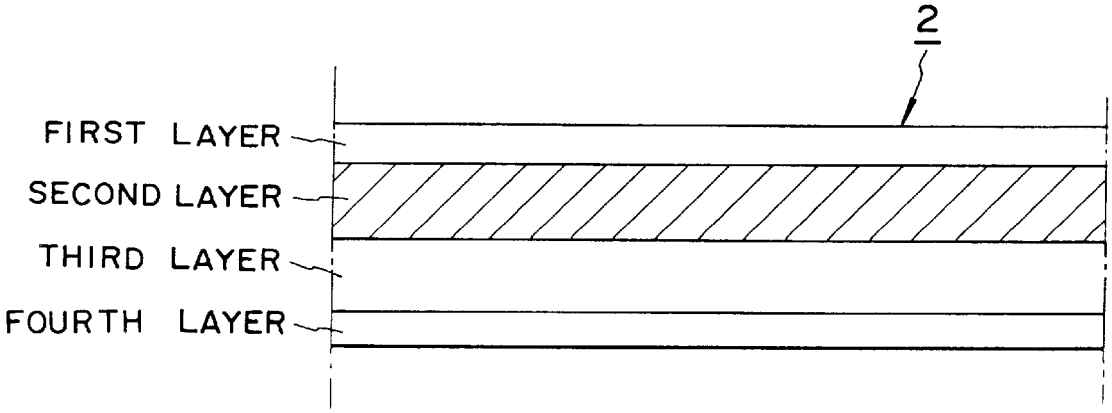
FIG. 14 is a cross-sectional view of an ink sheet.

As shown in FIGS. 12A and 12B, the reel gear 26*c* of the take-up reel 26 and the drive force transmitting gear 44*a* on the recording cover 11 side are brought into meshing engagement with each other to cause a rotational force to act on the drive force transmitting gear 44*a*, thereby creating an axial thrust in the take-up reel 26.

Also, the reel gear 25*c* of the supply reel 25 and the tension transmitting gear 45*a* on the recording cover 11 side are brought into meshing engagement with each other. When the ink sheet 2 wound on the supply reel 25 is taken up by the take-up reel 26, the supply. reel 25 is rotated by the tension acting on the ink sheet 2. When said rotational force acts from the reel gear 25*c* onto the tension transmitting gear 45*a* on the recording cover 11 side, the reel gear 25*c* creates an axial thrust in the supply reel 25. The helical gears 25*c* and 26*c* are installed so that at this time, the thrusts of the ink sheet reel 25 on the supply side and the ink sheet reel 26 on the take-up side may act in the same direction.

Accordingly, the thrusts acting on the reels 25 and 26 are transmitted to the bearings 27 fitted in the bearing grooves 39*b* and 40*b* provided in the recording cover 11. Said thrusts are then transmitted from the bearings 27 to the recording cover 11 and after all, the reels 25 and 26 are supported by the cover 11 in a state in which they are positioned at the side end in the same direction.

In the supply reel 25 and take-up reel 26 constructed as described above, an axial thrust acts during the conveyance of the ink sheet 2. Therefore, the reels 25 and 26 are always biased toward the bearing grooves 39*b* and 40*b* formed in the recording cover 11. Accordingly, the reels 25 and 26 are not moved axially during the conveyance of the ink sheet 2, whereby oblique movement of the ink sheet 2 is prevented and there is no possibility of jamming due to this oblique movement. Also, the thrusts of the reels 25 and 26 are received by the bearing grooves 39*b* and 4*b* and do not directly act on the ink cartridge 9 and therefore, it is not necessary to increase the rigidity of the ink cartridge 9.

If in the reel gears 25*c*, 26*c*, the drive force transmitting gear 44*a* and the tension transmitting gear 45*a* which are helical gears as described above, the torsion angle of the helical gears is smaller than 3°, insufficient axial thrust will be obtained, and if the torsion angle is greater than 20°, axial thrust will become great but will hinder the rotation of the gears, and therefore the torsion angle is set to the range of 3° to 30°, and may preferably be set to the range of 4°–15°, and may most preferably be set to the range of 5°–10°.

Also, in the present embodiment, it is preferable that the number of teeth of each of the reel gears 25*c* and 26*c* be set to e.g. 52 and the number of teeth of each of the drive force transmitting gear 44*a* and the tension transmitting gear 45*a* be set to e.g. 12. If the numbers of teeth of the gears 25*c*, 26*c*, 44*a* and 45*a* are so set, the optimum conveyance velocity of the ink sheet will be reasonably obtained and axial thrust will be obtained.

In the present embodiment, the multiprint system is adopted as the recording apparatus A, but in the case of such recording system, images are formed while the ink is sheared in the ink layer and therefore, to convey the ink sheet 2, it becomes necessary to overcome the frictional force between the ink sheet 2 and the recording head 3, plus the shearing force for the ink. For this reason, the conveying force exerted for the ink sheet 2 needs to be greater than the conveying force exerted when the conventional one-time ink sheet is used.

Also, in the multiprint system, it is necessary that the ink sheet 2 be reliably conveyed by 1/n lines each time images for one line are formed on the recording sheet 1, and it becomes possible to enhance the quality of recorded images by ensuring the conveyance can be effected reliably.

Figure 13:
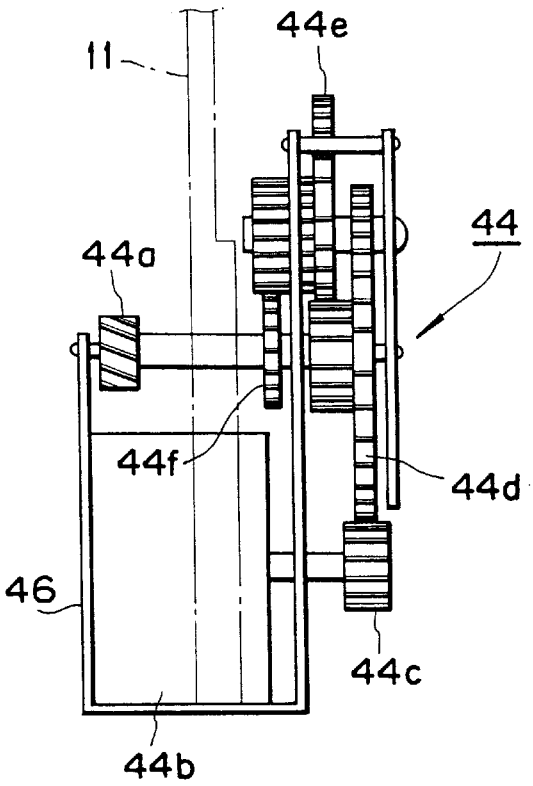
FIG. 13 illustrates a driving mechanism.

In order to satisfy such a condition, in the present embodiment, a driving mechanism 44 for the take-up reel 26 for conveying the ink sheet 2 is provided on a side of the recording cover 11, as shown in FIG. 2B. The driving mechanism 44 is constructed as shown in FIG. 13.

The driving mechanism 44 is such that a bracket 46 is secured to a side (in the present embodiment, the right side) of the recording cover 11 and a drive motor 44*b* is secured to the bracket 46. A motor gear 44*c* is mounted on the shaft of the drive motor 44*b*. A first reduction gear 44*d*, a second reduction gear 44*e* and a third reduction gear 44*f* which is formed integrally with the drive force transmitting gear 44*a* are rotatably mounted on the bracket 46 with a predetermined distance maintained between the shafts of the adjacent gears. Accordingly, the rotation of the drive motor 44*b* is reliably transmitted to the drive force transmitting gear 44*a* while being decelerated through the gears 44*c* to 44*d*–44*f*.

As described above, in the driving mechanism 44 in the present embodiment, it is possible that the rotation of the drive motor 44*b* is reliably transmitted to the drive force transmitting gear 44*a* and accordingly, it becomes possible to reliably convey the ink sheet 2 at a predetermined conveyance velocity.

In the present embodiment, as previously described, the restraining member 38 is provided in the recording cover 11 and the shaft 37 engageable with the restraining member 38 is provided in the apparatus body 7, and by closing the recording cover 11, the restraining member 38 is engaged with the shaft 37, thereby preventing the movement of the recording cover 11 in the longitudinal direction.

Description will now be made of a back tension imparting mechanism 45 for imparting back tension to the take-up reel 26. The back tension imparting mechanism 45, as shown in FIGS. 2A and 2B, is provided on the side plate 7*a* of the apparatus body 7.

The back tension imparting mechanism 45 is comprised of a pivotable plate 45$b_2$ constructed on the side plate 7*a* for pivotal movement about a pivot fulcruin 45$b_1$, a slide clutch 45*c* secured to the pivotable plate 45$b_2$ and connected to the tension transmitting gear 45*a*, and a tension spring 45 for upwardly biasing the pivotable plate 45$b_2$.

In the back tension imparting mechansim 45 constructed as described above, when the reel gear 25*c* of the supply reel 25 comes into meshing engagement with the tension transmitting gear 45*a* and the ink sheet 2 wound on the reel 25 is rewound, the reel 25 is rotated. The rotation of the supply reel 25 is transmitted from the reel gear 25*c* to the slide clutch 45*c* through the tension transmitting gear 45*a*. Thereby, predetermined back tension is imparted to the ink sheet 2.

Description will now be made of image formation in the recording apparatus A constructed as described above.

First, the recording cover 11 is opened as shown in FIG. 8 and the sheet roll la is contained into the roll holder 8, and then the leading end of the recording sheet 1 is drawn out to the platen roller 4. Then, the ink cartridge 9 is mounted in the recording cover 11 in the manner described previously, whereby the ink sheet 2 is loaded and the cover 11 is closed. By the recording cover 11 being thus closed, the supply reel 25 and the take-up reel 26 mounted in the ink cartridge 9 are fitted into the bearing grooves 39*a*, 39*b*, 40*a* and 40*b* and thus, the reels 25 and 26 are positioned at predetermined locations. At the same time, the restraining member 38 provided on the recording cover 11 comes into engagement with the shaft 37 provided in the apparatus body, whereby the recording cover 11 is set at a predetermined position relative to the apparatus body 7 and is restricted in its longitudinal movement.

Where an original 12 is placed on the original supporting table 13 formed on top of the recording cover 11 and the copying mode is selected in the operation panel C, the original 12 is read in the reading system B and at the same time, an image signal is transmitted to the recording apparatus A. At the same time, the platen 4 is driven by the motor 29 to convey the recording sheet 1 in the direction of arrow a and the ink sheet 2 is conveyed in the direction of arrow b by the drive motor 44*b*. The recording head 3 is driven in response to the transmitted image signal, whereby an image is formed on the recording sheet 1. The recording sheet 1 on which a predetermined image has been formed is further conveyed in the direction of arrow a and, when the end portion of the image comes to the cutter 5, the cutter 5 is driven to cut the recording sheet 1. The cut recording sheet is conveyed and discharged out of the apparatus by the pair of conveying rollers 6. Also, the recording sheet 1 is conveyed in the direction opposite to the direction of arrow a by the platen roller 4.

In the manner described above, a predetermined image can be formed on the recording sheet 1.

The aforedescribed embodiment has been shown with respect to a case where the numbers of teeth of the drive force transmitting gear 44*a* and the tension transmitting gear 45*a* are the same, but gears having different numbers of teeth may also be used. By freely choosing the numbers of teeth of the drive force transmitting gear and the tension transmitting gear, the conveyance velocity of the ink sheet by the drive force transmitting gear and the tension to the ink sheet by the tension transmitting gear and the back tension imparting mechanism can be selected independently of each other. If in the present embodiment, the numbers of teeth of the helical gears are chosen to be between 50 to 54, the number of teeth of the drive force transmitting gear 44*a* may be set to be between 14–20, preferably 16–18. The number of teeth of the tension transmitting gear 45*a* may be set to be between 15–21, preferably 17–19.

If the numbers of teeth of the helical gears and the transmitting gears are so set, the torsion angle of the helical gears may be set to the range of 3° to 30° with the thrust created by the helical gears being taken into account, and may preferably be set to the range of 5° to 20°, and may most preferably be set to the range of 10° to 16°.

Also, in the aforedescribed embodiment, an application of the present invention to the ink cartridge 9 has been shown, but of course, the present invention is also applicable to a case where the recording apparatus is loaded with ink sheet reels (the supply reel 25 and the take-up reel 26) which are not contained in the cartridge 9A.

Also, the multiprint system has been shown as being used in a heat transfer recording system, but the present invention is euqally applicable to a recording apparatus of the type in which ink is completely transferred to the recording sheet 1 by one time image recording.

The helical gears mentioned herein refer to a gear in which the tooth face is helical and the pitch surface is a cylindrical surface and a gear which has a thread or multiple threads and is of a similar shape. The tooth face may be straight or curved relative to the cylindrical surface, or some of the tooth faces may be opposite in direction on the cylindrical surface. In short, any gear which can create axial thrust is covered by the term "helical gears" used herein.

So, in the aforedescribed embodiment, there has been shown a case where helical gears (the reel gears 25*c* and 26*c*) are used as gear means for creating an axial thrust, whereas this is not restrictive, but an axial thrust can also be created, for example by the use of bevel gears or the like, and it is to be understood that these gears are also covered by the term "helical gears" used herein.

Also, there has been shown a case where the recording cover 11 side is loaded with the ink cartridge 9 (the supply reel 25 and the take-up reel 26), but the apparatus body 7 side may also be loaded with the ink cartridge.

The ink cartridge 9 has been shown as having been molded as a unit by the use of plastic, but alternatively, the first housing 9*a*, the second housing 9*b*, etc. may be formed as discrete parts.

Also, there has been shown a case where the cartridge 9A which is the frame member of the ink cartridge 9 is constructed so as to cover the ink sheet 2 substantially completely, except the portion in which the recording head 3, etc. are inserted, but alternatively, use may be made of a cartridge comprising a framework portion large enough to hold the ink sheet reels (the supply reel 25 and the take-up reel 26).

In the aforedescribed embodiment, an ink sheet retaining ink therein from first is used as the ink sheet 2, but of course, use may also be made of a sheet which does not retain ink therein when it is wound on the supply reel, but is made to retain ink therein after it is fed from the supply reel. In such case, the sheet-like member wound on the supply reel may be any one capable of retaining ink therein, such as an ink sheet of the material as mentioned previously having a minute porous net-like structure on the base film thereof.

The present invention, as described previously, is provided with an ink sheet winding portion on which an ink sheet can be wound, and power transmitting means provided in this ink sheet winding portion for creating an axial thrust in the ink sheet winding portion and therefore, can eliminate axial jolting without the necessity of providing spring means as in the prior art, thereby effectively preventing oblique movement or the like of the ink sheet and improving the quality of printing, as well as reducing the number of parts and achieving a reduction in cost.

Also, where design is made such that said axial thrust is received by the loading portion of the recording apparatus, it is not required to modify the frame member of the ink cartridge containing the ink sheet reels in the frame member to have increased rigidity, and this also leads to the possibility of reducing the cost.

We claim:

1. An ink sheet cartridge removably provided on a loading portion of a recording apparatus, said ink sheet cartridge comprising:

a frame member dimensioned so that said cartridge can be loaded into said recording apparatus;

a supply reel held by said frame member, having play in an axial direction, and provided with an ink sheet mounting portion for mounting an ink sheet thereon, and said ink sheet mounting portion having power transmission means comprising a helical gear for transmitting power to rotate said ink sheet mounting portion while also exerting an axial thrust along said ink sheet mounting portion and only to a bearing portion, and not to said frame member, only when said ink sheet mounting portion rotates, said bearing portion being contained within said loading portion of said recording apparatus when said ink sheet cartridge is provided in said recording apparatus; and a take-up reel held by said frame member, having play in an axial direction, for taking up the ink sheet from said supply reel, said take-up reel being provided with an ink sheet mounting portion for mounting the ink sheet thereon, and with power transmission means comprising a helical gear for transmitting power to rotate said ink sheet mounting portion while also exerting an axial thrust along said ink sheet mounting portion and only to a bearing portion, and not to said frame member, only when said ink sheet mounting portion rotates, said bearing portion being contained within said loading portion of said recording apparatus when said ink sheet cartridge is provided in said recording apparatus;

wherein the axial thrust of said power transmission means of said supply reel and the axial thrust of said power transmission means of said take-up reel act in a same direction.

2. An ink sheet cartridge according to claim 1, wherein a torsion angle of said helical gear is 10°–16°.

3. An ink sheet cartridge according to claim 1, further comprising a drive force transmitting gear on a side of said recording apparatus, said drive force transmitting gear having a number of teeth which is 14–20, and when a number of teeth of said helical gear is 50–54, a torsion angle of said helical gear is 3°–30°.

4. An ink sheet cartridge according to claim 1, wherein a torsion angle of said helical gear is 4°–15°.

5. An ink sheet cartridge according to claim 1, wherein a torsion angle of said helical gear is 5°–10°.

6. An ink sheet cartridge according to claim 1, wherein said recording apparatus includes a drive force transmitting gear on a side of said recording apparatus, said drive force transmitting gear having a number of teeth which is 14–20, and when the number of teeth of said helical gear is 50–54, the torsion angle of said helical gear is 5°–20°.

7. An ink sheet cartridge according to claims 1, wherein said recording apparatus includes a drive force transmitting gear on a side of said recording apparatus, said drive force transmitting gear having a number of teeth which is 14–20, and when the number of teeth of said helical gear is 50–54, the torsion angle of said helical gear is 10°–16°.

8. A recording apparatus for recording a plurality of images on a recording medium, said apparatus comprising:

a loading portion for removably loading an ink sheet cartridge having a frame member dimensioned so that the cartridge can be loaded into said recording apparatus and at least two ink sheet reels each held by said frame member and each having play in an axial direction of said ink sheet reels and a plurality of power transmitting means each comprising a helical gear located by each of said ink sheet reels such that each of said helical gears generates an axial thrust along said ink sheet reel and only to a bearing portion and not to said frame member, only when said ink sheet reels rotate, said bearing portion being contained within said loading portion of said recording apparatus when the ink sheet cartridge is provided in said recording apparatus;

recording means for acting on an ink sheet in said ink sheet cartridge loaded into said loading portion to record said images on said recording medium;

a plurality of power transmission means for transmitting power to said helical gears of said ink sheet cartridge at said ink sheet reels provided for transporting said ink sheet while also exerting a force that securely positions said ink sheet, said plurality of power transmission means transmitting power to said helical gears of said ink sheet cartridge to generate an axial thrust force at said helical gears for biasing said ink sheet reels in the same direction and only to said bearing portion within said loading portion; and conveying means for conveying said recording medium.

9. A recording apparatus according to claim 8, wherein each said helical gear has a torsion angle and a number of teeth.

10. A recording apparatus according to claim 9, wherein the number of teeth of each said helical gear is 52, said recording apparatus further comprising a gear on a of side recording apparatus which meshes with each said helical gear and has 12 teeth.

11. A recording apparatus according to claim 9, wherein said plurality of power transmission means each comprise a gear on a side of said recording apparatus which meshes with each said helical gear, said gear comprising either a drive force transmitting gear or a tension transmitting gear of said recording apparatus, the drive force transmitting gear having a different number of teeth than the tension transmitting gear.

12. A recording apparatus according to claim 11, wherein the number of teeth of said gear on said side of said recording apparatus which meshes with each said helical gear is greater in the tension transmitting gear than in the drive force transmitting gear.

13. A recording apparatus according to claim 8, wherein said recording means has a thermal head.

* * * * *

UNITED STATES PATENT AND TRADEMARK OFFICE

CERTIFICATE OF CORRECTION

PATENT NO. : 5,936,654

DATED : August 10, 1999

INVENTOR(S) : Minoru Yokoyama et al.

It is certified that error appears in the above-identified patent and that said Letters Patent is hereby corrected as shown below:

On the title page, items

At [56], FOREIGN PATENT DOCUMENTS

"0204585 11/1984" should read --59-204585 11/1984--.

At [57], ABSTRACT

"capable,of" should read --capable of--.

COLUMN 1

Line 49, "lush" should read --some play--.

COLUMN 3

Line 33, "with" should be deleted.

COLUMN 6

Line 32, "moustache-like" should read --moustache like"--.
Line 50, "moustache-like" should read --moustache like--.

UNITED STATES PATENT AND TRADEMARK OFFICE

CERTIFICATE OF CORRECTION

PATENT NO. : 5,936,654

DATED : August 10, 1999

INVENTOR(S) : Minoru Yokoyama et al.

It is certified that error appears in the above-identified patent and that said Letters Patent is hereby corrected as shown below:

COLUMN 7

Line 21, "u-grooves" should read --U-grooves--.
Line 60, "1" should be deleted.

COLUMN 8

Line 12, "Arecording" should read --A recording--.
Line 66, "is-positioned" should read --is positioned--.

COLUMN 14

Line 5, "to e.g." should read --to, e.g.,--.
Line 7, "to e.g." should read --to, e.g.,--.

Signed and Sealed this

Fourteenth Day of March, 2000

*Attest:*

Q. TODD DICKINSON

*Attesting Officer*

*Commissioner of Patents and Trademarks*